US010215475B2

(12) United States Patent
Chow et al.

(10) Patent No.: US 10,215,475 B2
(45) Date of Patent: Feb. 26, 2019

(54) UNIVERSAL FIXING SYSTEM FOR A RANGE OF MODULAR REFRIGERATOR COMPONENTS

(71) Applicant: WHIRLPOOL CORPORATION, Benton Harbor, MI (US)

(72) Inventors: Daniel Chow, St. Joseph, MI (US); Wesley Mendez, Monterrey (MX); Sergio Moreno, Apodaca (MX); Fabian Taboada, Monterrey (MX); Jason W. Tippetts, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/683,361

(22) Filed: Aug. 22, 2017

(65) Prior Publication Data

US 2017/0350639 A1 Dec. 7, 2017

Related U.S. Application Data

(62) Division of application No. 14/923,948, filed on Oct. 27, 2015, now Pat. No. 9,784,494.
(Continued)

(51) Int. Cl.

| | |
|---|---|
| ***F25D 23/06*** | (2006.01) |
| ***F25D 23/04*** | (2006.01) |
| *F25D 27/00* | (2006.01) |

(52) U.S. Cl.
CPC ..... *F25D 23/067* (2013.01); *F25D 23/04* (2013.01); *F25D 23/066* (2013.01);
(Continued)

(58) Field of Classification Search
CPC ..... F25D 23/067; F25D 23/04; F25D 23/066; F25D 23/061; F25D 2325/021; F25D 27/00
See application file for complete search history.

(56) References Cited

U.S. PATENT DOCUMENTS

| | | | |
|---|---|---|---|
| 2,262,578 | A | 11/1941 | Ellis |
| 2,453,387 | A | 11/1948 | Rundell |

(Continued)

FOREIGN PATENT DOCUMENTS

| | | |
|---|---|---|
| CN | 2919145 | 7/2007 |
| CN | 203047765 | 7/2013 |

(Continued)

*Primary Examiner* — Hanh V Tran
(74) *Attorney, Agent, or Firm* — Price Heneveld LLP

(57) ABSTRACT

A modular component fixing system for an appliance including a refrigerating appliance having an inner liner defining a plurality of modular attachment slots, each having an upturned flange defining an angular recess. Each modular attachment slots includes a downwardly angled channel in communication with the angular recess. Each of a plurality of modular components includes an abutment surface and a supporting flange extending from the abutment surface at a predetermined angle, the predetermined angle of the supporting flange being substantially similar to a recess angle define by the angular recess, wherein each modular component is configured to be removably engaged with any one of the plurality of modular attachment slots by inserting the supporting flange into a corresponding angular recess of the one of the plurality of modular attachment slots such that the abutment surface is substantially flush with an interior surface of the inner liner.

9 Claims, 22 Drawing Sheets

Related U.S. Application Data

(60) Provisional application No. 62/069,014, filed on Oct. 27, 2014.

(52) U.S. Cl.
CPC ..... *F25D 23/061* (2013.01); *F25D 27/00* (2013.01); *F25D 2325/021* (2013.01)

(56) References Cited

U.S. PATENT DOCUMENTS 2,852,328 A * 9/1958 Jewell ..... F25D 23/04 211/134
2,970,873 A * 2/1961 Johnson ..... F25D 23/04 312/405.1
2,976,098 A * 3/1961 Combs ..... F25D 23/04 312/405.1
4,615,448 A 10/1986 Johnstonbaugh
4,779,939 A 10/1988 Stich
4,904,032 A * 2/1990 Jenkins ..... F25D 23/066 108/107
5,018,323 A 5/1991 Clausen
5,138,803 A 8/1992 Grossen
5,346,299 A * 9/1994 Werkmeister ..... F25D 23/04 312/405.1
5,375,924 A * 12/1994 Pohl ..... A47B 57/10 108/109
5,454,638 A 10/1995 Bird et al.
5,642,924 A * 7/1997 Wohlrab ..... A47B 57/16 211/134
5,769,520 A 6/1998 Jun et al.
6,220,684 B1 4/2001 Bent et al.
6,640,581 B1 11/2003 Choi
6,908,163 B1 6/2005 Hebeler et al.
8,459,818 B2 * 6/2013 Becke ..... F25D 27/00 362/154
8,915,561 B2 12/2014 Eichman et al.
9,103,581 B2 * 8/2015 Babinski ..... F25D 25/024
9,103,582 B2 8/2015 Nash et al.
9,127,877 B2 9/2015 Lee et al.
9,366,473 B2 * 6/2016 Bormann ..... F25D 23/067
9,389,012 B2 7/2016 Rackley et al.
9,400,132 B2 7/2016 Shrader et al.
9,468,313 B2 10/2016 Kniffen
2003/0011291 A1 1/2003 Moreno-Olguin et al.
2003/0020387 A1 1/2003 Wing et al.
2003/0046951 A1 3/2003 Kim et al.
2003/0173882 A1 9/2003 Koons
2004/0011075 A1 1/2004 Eveland et al.
2004/0182727 A1 9/2004 Becke et al.
2004/0183416 A1 9/2004 Becke et al.
2004/0223831 A1 11/2004 Whitaker
2005/0067930 A1 3/2005 Shin
2005/0173600 A1 8/2005 Morris
2006/0010829 A1 1/2006 De Sa Cavalcanti et al.
2006/0152123 A1 7/2006 Collins et al.
2006/0163985 A1 * 7/2006 Blersch ..... F25D 23/067 312/408
2006/0198985 A1 9/2006 Knoller
2007/0210089 A1 * 9/2007 Kauk ..... B29C 44/16 220/592.1
2007/0228911 A1 10/2007 Kim et al.
2007/0252498 A1 11/2007 Wing
2008/0048540 A1 * 2/2008 Kim ..... F25D 23/067 312/408
2009/0033191 A1 2/2009 Kim
2009/0058248 A1 3/2009 Gossens et al.
2009/0302724 A1 * 12/2009 Allard ..... F25D 17/042 312/237
2010/0031690 A1 2/2010 Becke
2010/0283368 A1 11/2010 Lee
2010/0326122 A1 12/2010 Seo et al.
2011/0204762 A1 8/2011 Eubanks et al.
2012/0091084 A1 4/2012 Amaral et al.
2013/0081421 A1 * 4/2013 Kwon ..... F25D 23/04 62/440
2014/0042886 A1 2/2014 Baldo
2016/0131415 A1 5/2016 Shrader et al.
2016/0131416 A1 * 5/2016 Sankhgond ..... F25D 23/067 312/408
2016/0290711 A1 * 10/2016 Brown ..... F25D 25/02

FOREIGN PATENT DOCUMENTS

CN 103712404 4/2014
DE 102009045057 3/2011
EP 675332 1/2001

* cited by examiner

UNIVERSAL FIXING SYSTEM FOR A RANGE OF MODULAR REFRIGERATOR COMPONENTS

CROSS-REFERENCE TO RELATED APPLICATIONS

This application is a divisional of U.S. patent application Ser. No. 14/923,948, filed Oct. 27, 2015, entitled UNIVERSAL FIXING SYSTEM FOR A RANGE OF MODULAR REFRIGERATOR COMPONENTS, which claims priority to and the benefit under 35 U.S.C. § 119(e) of U.S. Provisional Patent Application No. 62/069,014, filed on Oct. 27, 2014, entitled UNIVERSAL FIXING SYSTEM FOR A RANGE OF MODULAR REFRIGERATOR COMPONENTS, the entire disclosures of which are hereby incorporated herein by reference.

FIELD OF THE DEVICE

The device is in the field of fixing systems for refrigerating appliances and modular components that can be attached to the fixing system for the refrigerating appliance.

BRIEF SUMMARY OF THE DEVICE

An aspect of the present device is generally directed toward a modular component fixing system for an appliance including a refrigerating appliance having an outer wrapper and an inner liner defining an insulating cavity therebetween, the insulating cavity being substantially filled with an insulation member, wherein the inner liner at least partially defines an interior volume of the refrigerating appliance. A plurality of modular attachment slots are defined within the inner liner, each of the plurality of modular attachment slots having an upturned flange that defines an angular recess, and wherein each of the modular attachment slots includes at least one downwardly angled channel in communication with the angular recess. A plurality of modular components include an abutment surface and a supporting flange extending from the abutment surface at a predetermined angle. The predetermined angle of the supporting flange is substantially similar to a recess angle defined by the angular recess, wherein each modular component is configured to be removably engaged with any one of the plurality of modular attachment slots by inserting the supporting flange into a corresponding angular recess of the one of the plurality of modular attachment slots such that the abutment surface is substantially flush with an interior surface of the inner liner.

According to another aspect of the present device, a component fixing system for an appliance includes an inner liner of a refrigerating appliance, the inner liner defining at least one refrigerating compartment. A door liner of a refrigerator door at least partially defines the refrigerating compartment when the refrigerator door is in a closed position relative to the refrigerating compartment. A plurality of fixing coves is defined within each of the liner and the door liner, wherein each of the plurality of fixing coves includes an inward portion that defines an angular recess. Each of the plurality of fixing coves includes a downward drain channel extending from the angular recess. A plurality of modular components includes an abutment surface and a supporting flange extending from the abutment surface at a predetermined angle. The predetermined angle of the supporting flange is substantially similar to a recess angle defined by the angular recess. Each modular component is configured to be removably engaged with any one of the plurality of fixing coves by inserting the supporting flange into a corresponding angular recess of the one of the fixing coves such that the abutment surface is substantially flush with the interior surface of the inner liner.

Yet another aspect of the present device includes an insulated wall panel system for an appliance including an inner liner, the inner liner having an interior surface that defines an appliance compartment. The inner liner includes a plurality of convex folds that extend outward from the appliance compartment, each of the convex folds defining an angular recess that extends outward from a recess aperture defined by the interior surface of the inner liner. The angular recess is in communication with the appliance compartment through the recess aperture. Each of the convex folds further includes a downwardly extending surface that extends downward from an outermost portion of the angular recess toward the recess aperture. An outer wrapper is disposed around the inner liner and cooperatively defines an insulating cavity with the inner liner. An insulation layer is disposed within the insulating cavity, wherein each of the plurality of convex folds extend into the insulation layer. A plurality of modular components includes an abutment surface and a supporting flange extending from the abutment surface at a predetermined angle. The predetermined angle of the supporting flange is substantially similar to a recess angle defined by the angular recess. Each modular component is configured to be removably engaged with any one of the plurality of convex folds by inserting the supporting flange into a corresponding angular recess of one of the plurality of convex folds such that the abutment surface is substantially flush with the interior surface of the inner liner.

These and other features, advantages, and objects of the present device will be further understood and appreciated by those skilled in the art by reference to the following specification, claims, and appended drawings.

BRIEF DESCRIPTION OF THE DRAWINGS

The foregoing summary, as well as the following detailed description of the device, will be better understood when read in conjunction with the appended drawings. For the purpose of illustrating the device, there are shown in the drawings, certain embodiment(s) which are presently preferred. It should be understood, however, that the device is not limited to the precise arrangements and instrumentalities shown. Drawings are not necessary to scale. Certain features of the device may be exaggerated in scale or shown in schematic form in the interest of clarity and conciseness.

DETAILED DESCRIPTION

Figure 1:
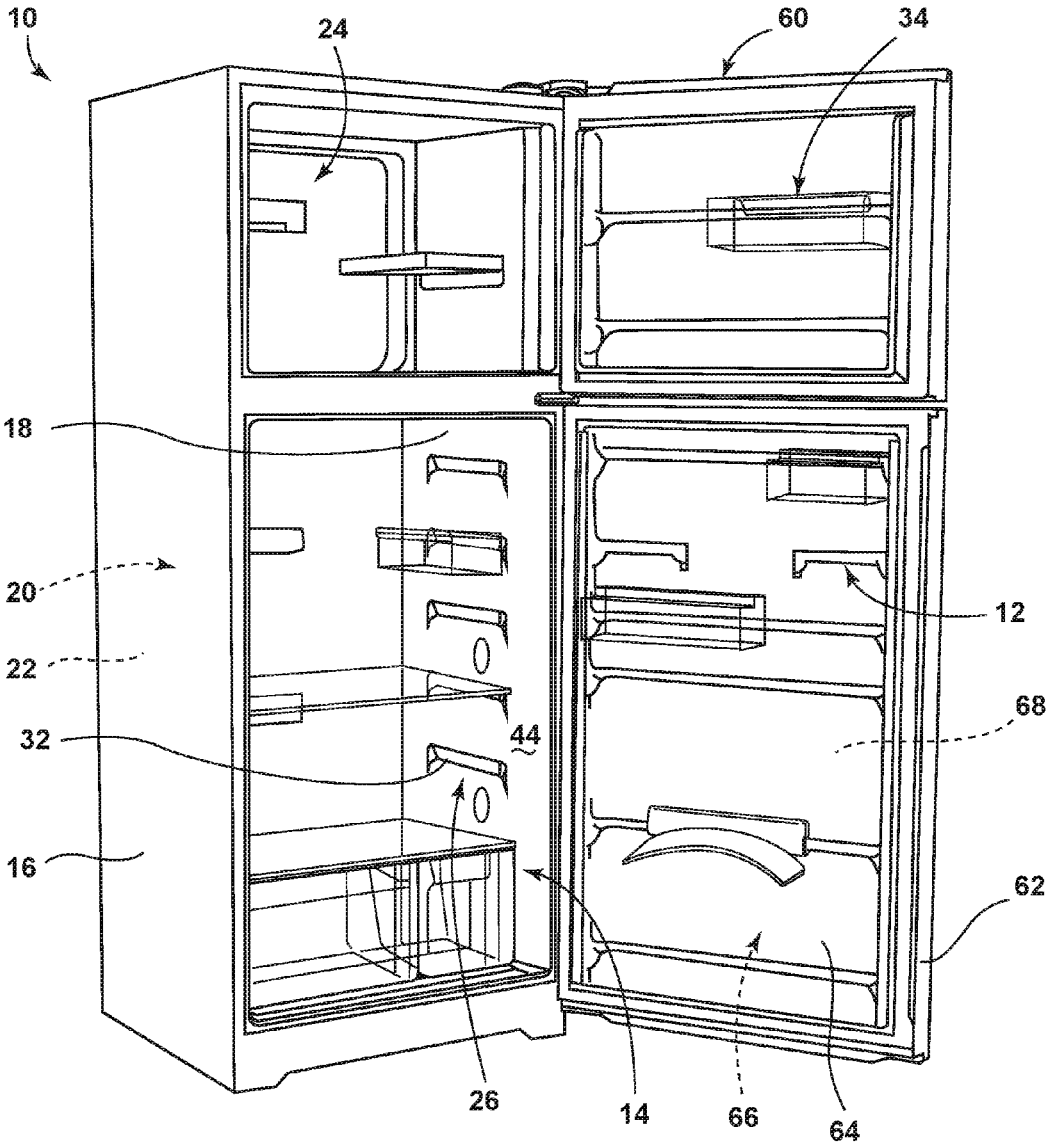
FIG. 1 is a front perspective view of a refrigerator appliance incorporating an aspect of the universal modular component fixing system.
Figure 2:
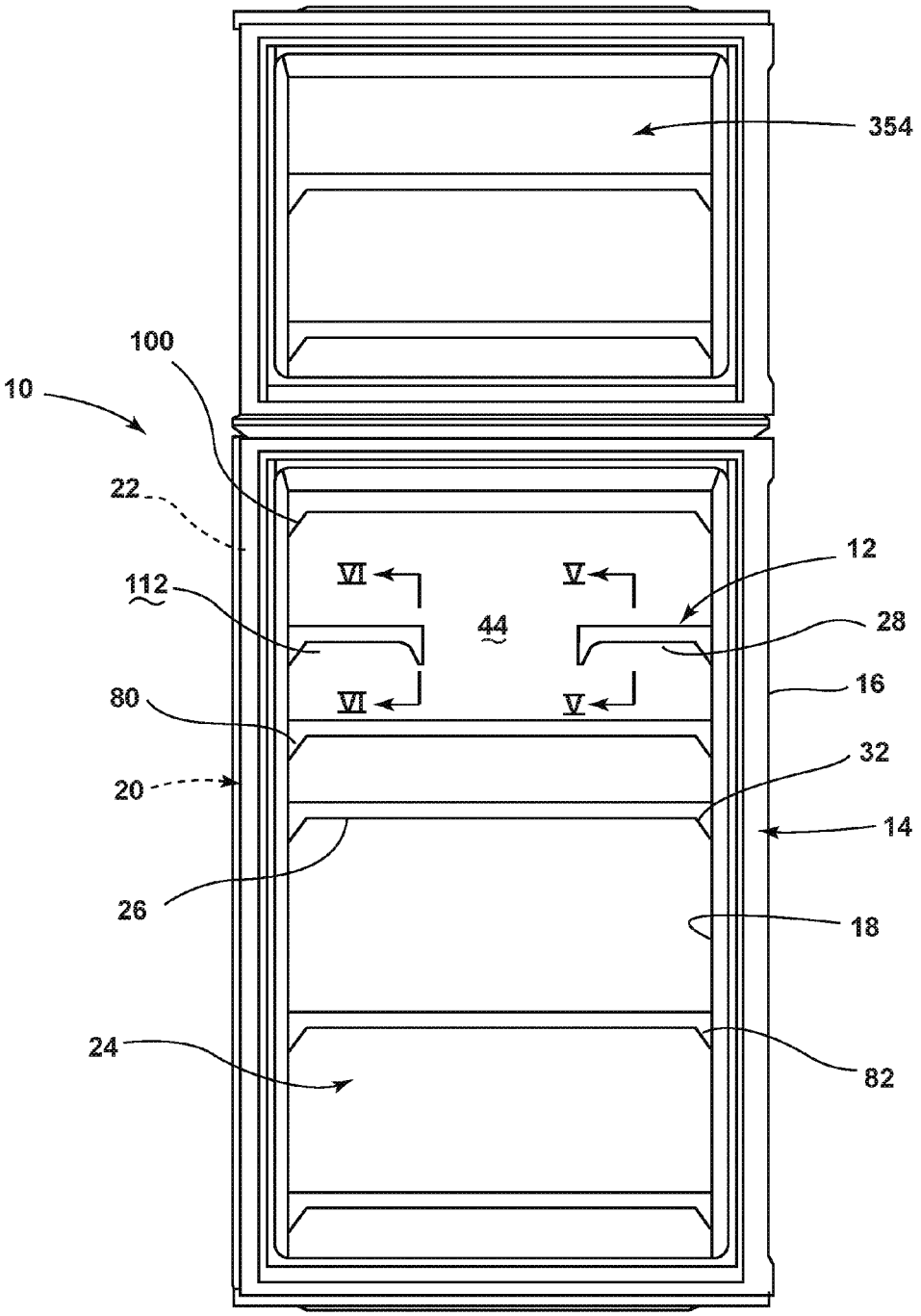
FIG. 2 is a front elevation view of a door of a refrigerating appliance incorporating another aspect of the universal modular component fixing system.
Figure 3:
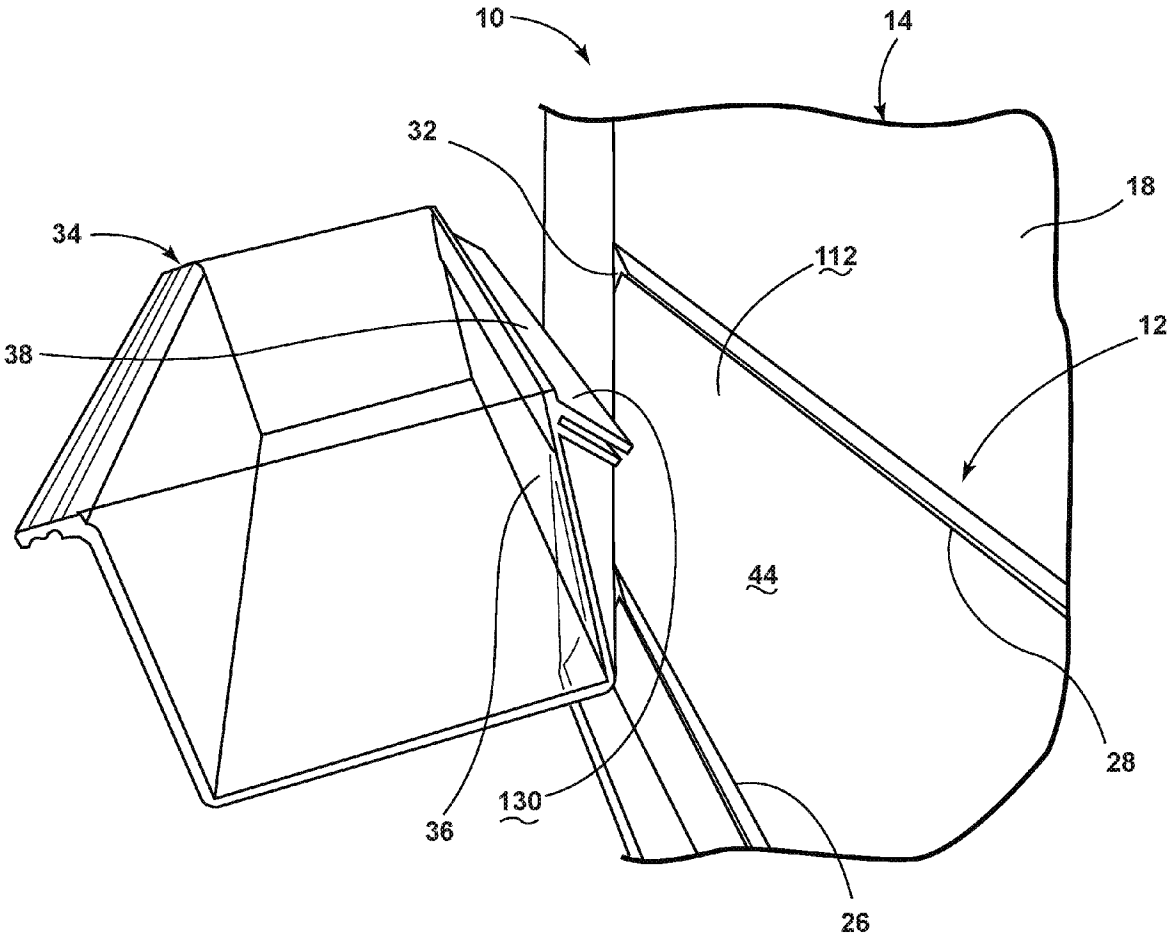
FIG. 3 is an enlarged perspective view of a modular component positioned adjacent to a modular attachment slot of an aspect of the universal modular component fixing system.
Figure 4:
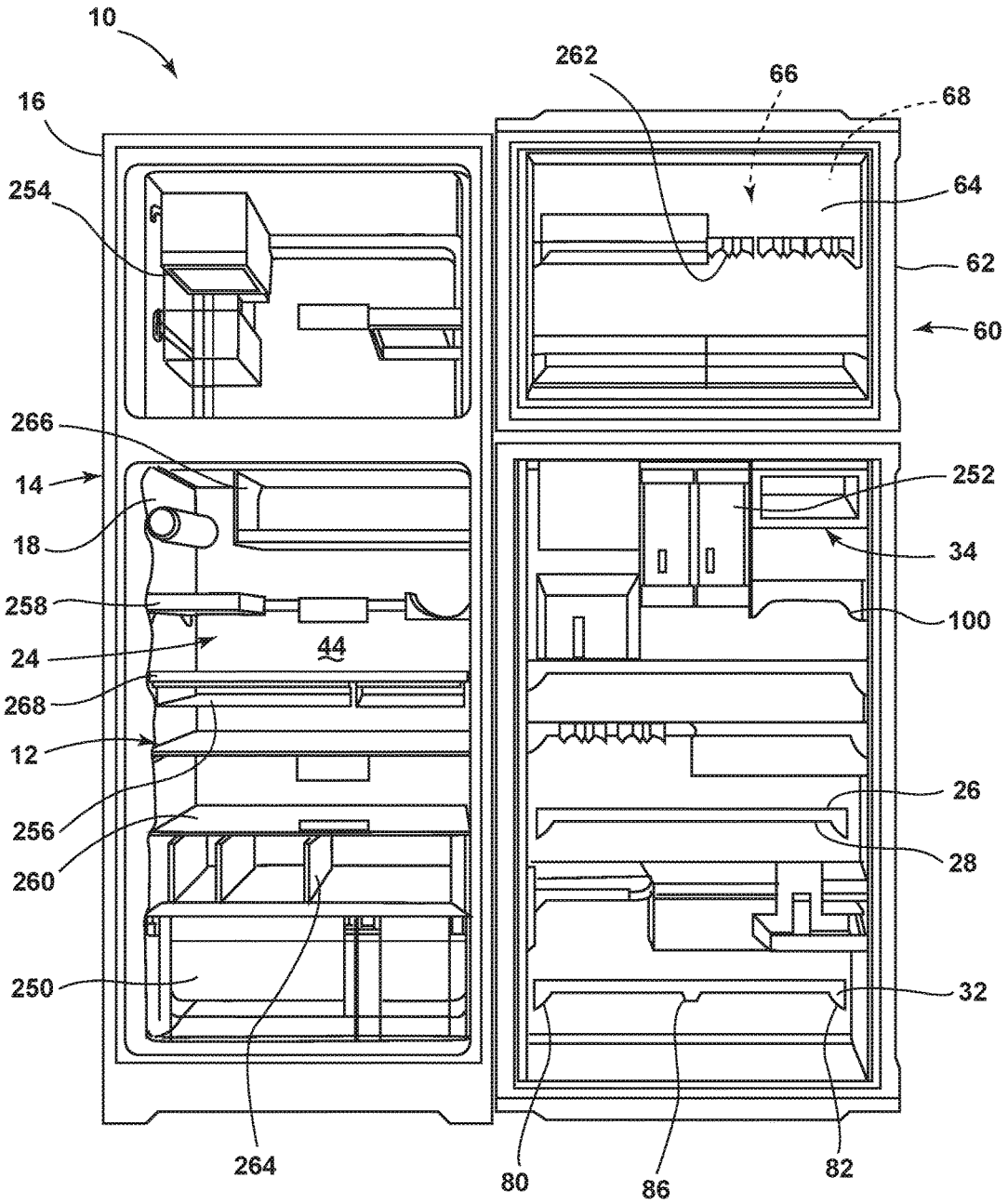
FIG. 4 is a front perspective view of a refrigerating appliance incorporating a plurality of modular components into the universal modular component fixing system.
Figure 5:
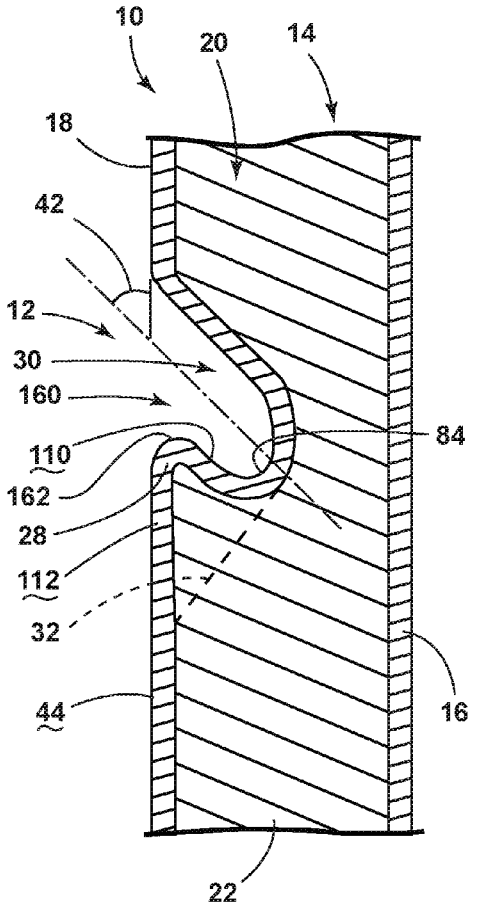
FIG. 5 is a cross-sectional view of the refrigerating appliance of FIG. 2 taken along line V-V.
Figure 6:
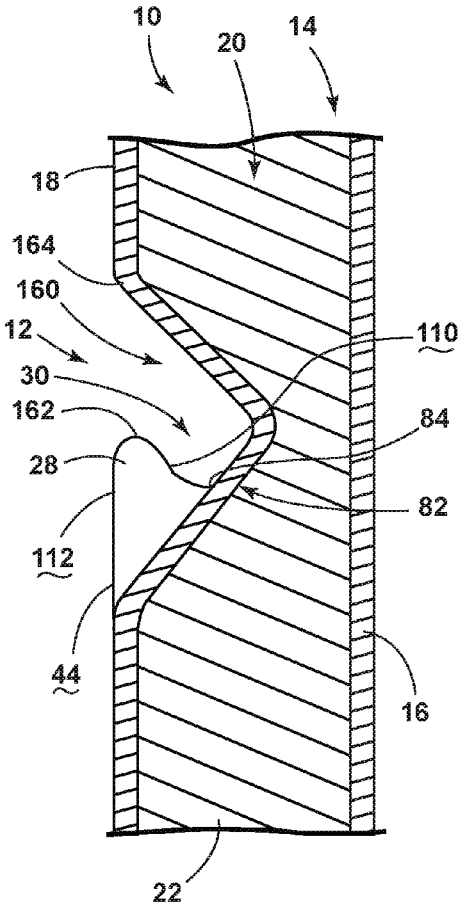
FIG. 6 is a cross-sectional view of the refrigerating appliance of FIG. 2 taken along line VI-VI.
Figure 7:
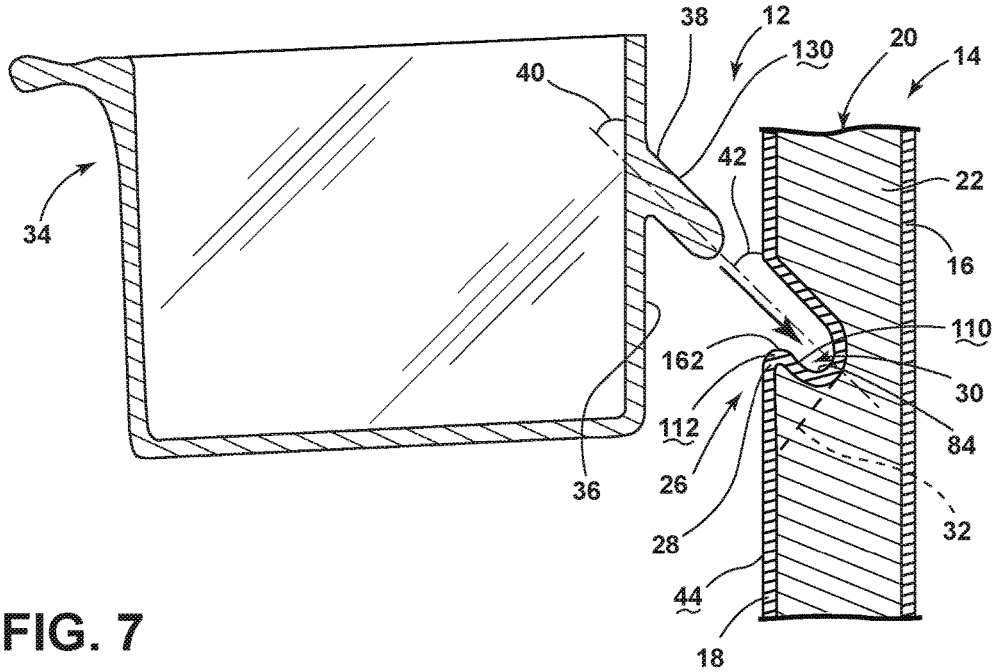
FIG. 7 is a detail cross-sectional view of FIG. 5 illustrating a modular component positioned adjacent to a modular attachment slot of the universal modular component fixing system.
Figure 8:
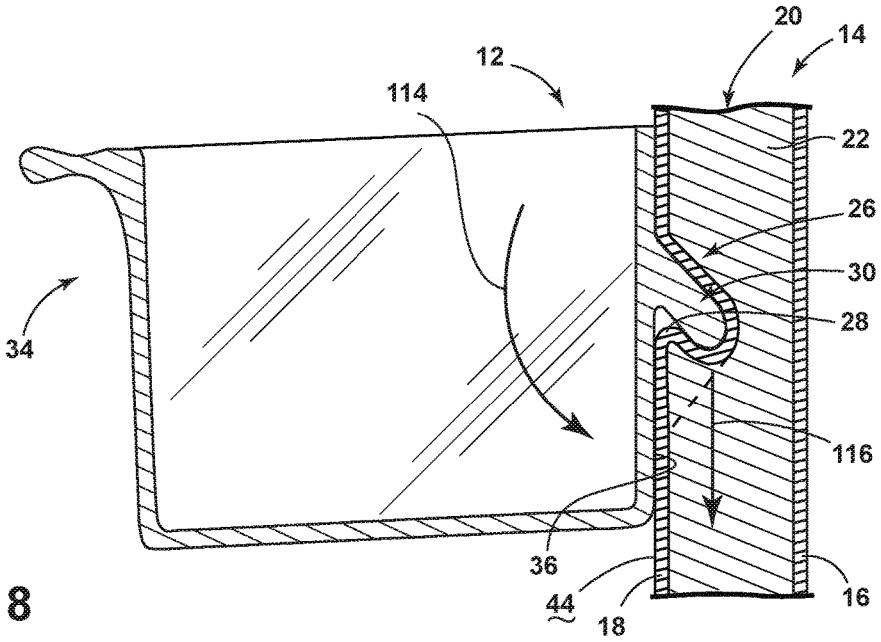
FIG. 8 is an enlarged cross-sectional view of the universal modular component fixing system of FIG. 7 showing the modular component engaged with the modular attachment slot.

Before the subject device is described further, it is to be understood that the device is not limited to the particular embodiments of the device described below, as variations of the particular embodiments may be made and still fall within the scope of the appended claims. It is also to be understood that the terminology employed is for the purpose of describing particular embodiments, and is not intended to be limiting. Instead, the scope of the present device will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the device. The upper and lower limits of these smaller ranges may independently be included in the smaller ranges, and are also encompassed within the device, subject to any specifically excluded limit in the stated range. Where the stated range includes one or both of the limits, ranges excluding either or both of those included limits are also included in the device.

In this specification and the appended claims, the singular forms "a," "an" and "the" include plural reference unless the context clearly dictates otherwise.

With respect to FIGS. 1-8, a refrigerating appliance 10 is generally shown. In each of these embodiments, the refrigerating appliance 10 includes a universal modular component fixing system 12 incorporated within various insulated walls 14 of the refrigerating appliance 10. The refrigerating appliance 10 includes an outer wrapper 16 and an inner liner 18 defining an insulating cavity 20 defined therebetween. The insulating cavity 20 is substantially filled with an insulating member 22. The inner liner 18 of the refrigerating appliance 10 at least partially defines an interior volume 24 of the refrigerating appliance 10. A plurality of modular attachment slots 26 is defined within the inner liner 18 wherein each of the modular attachment slots 26 includes an upturned flange 28 that defines an angular recess 30. Each modular attachment slot 26 also includes at least one downwardly angled channel 32 in communication with the angular recess 30. A plurality of modular components 34 is adapted to engage the angular recess 30 of one or more of the modular attachment slots 26. Each of the modular components 34 includes an abutment surface 36 and a supporting flange 38 that extends from the abutment surface 36 at a predetermined angle 40. The predetermined angle 40 of the supporting flange 38 is substantially similar to a recess angle 42 defined by the angular recess 30 of the modular attachment slots 26. Each modular component 34 is configured to be removably engaged with any one or more of the plurality of modular attachment slots 26 by inserting the supporting flange 38 into a corresponding angular recess 30 of one of the plurality of modular attachment slots 26. In this manner, the abutment surface 36 of the modular component 34 is substantially flush with an interior surface 44 of the inner liner 18.

Referring now to FIGS. 1-10, a door 60 to the refrigerating appliance 10 includes an outer door wrapper 62 and an inner door liner 64 that cooperatively define a door cavity 66 therebetween. The door cavity 66 is substantially filled with a door insulation member 68. The inner door liner 64 at least partially defines the interior volume 24 of the refrigerating appliance 10 when the door 60 is disposed in a closed position. The inner door liner 64 also includes at least a portion of the plurality of modular attachment slots 26 that are configured to removably receive at least one or more of the plurality of modular components 34.

Referring now to the various aspects illustrated in FIGS. 2-8, the structure of the refrigerating appliance 10 can be formed by vacuum forming the inner liner 18 to include the plurality of modular attachment slots 26 in the form of sumps disposed within the surface of the inner liner 18. The insulating member 22 disposed within the structural wall 14 of the refrigerating appliance 10, whether in the wall of the cabinet or the door 60, can be a vacuum-insulated panel that is preformed or formed within the insulating cavity 20 defined between the inner liner 18 and the outer wrapper 16. Additionally, the insulating member 22 can be a spray foam insulation member, solid insulation member, a particulate insulating material, combinations thereof, or other similar insulating material. It is contemplated that the insulating member 22 disposed within the insulating cavity 20 defined between the inner liner 18 and the outer wrapper 16 is configured to at least partially enter into the upturned flange 28 defined by the inner liner 18 proximate the various modular attachment slots 26 of the universal modular component fixing system 12.

Referring now to FIGS. 2 and 4-6, each of the modular attachment slots 26 of the universal modular component fixing system 12 can include first and second ends 80, 82. In the various embodiments, each of the first and second ends 80, 82 can include a downwardly angled channel 32. It is contemplated that during use, it may become necessary for the user to remove particles, fluids, and other debris that may become deposited in the angular recess 30 defined by the upturned flange 28 of the modular attachment slots 26. To provide for easy removal of such debris, the downwardly angled channel 32 can be disposed at the first and second ends 80, 82 of each of the modular attachment slots 26. The downwardly angled channels 32 provide for a generally downward flow path where such debris can be removed. As the debris is moved toward the first or second ends 80, 82 of the modular attachment slot 26, the debris can be moved into the downwardly angled channel 32 and easily evacuated from the modular attachment slot 26 through gravity. Accordingly, a base 84 of each upturned flange 28 at the bottom of the angular recess 30, in combination with the downwardly angled channels 32, forms a continuous surface that is configured to allow material to flow or otherwise be removed from the angular recess 30 and out of the modular attachment slot 26.

According to various embodiments, the base 84 of the upturned flange 28 can be cambered or sloped toward one or both of the first or second ends 80, 82 of the modular attachment slot 26 such that fluid disposed within the angular recess 30 will tend to flow with the force of gravity within the downwardly angled channels 32 such that fluid and debris can easily be evacuated from the modular attachment slots 26. It is also contemplated that each modular attachment slot 26 can include intermediate downward channels 86 (shown in FIG. 4) disposed along various internal points of one or more of the modular attachment slots 26. Such a configuration can be implemented where a particular modular attachment slot 26 extends substantially across a full length of a structural wall 14 of the refrigerating appliance 10. Such intermediate downward channels 86 can provide a plurality of regions through which debris can be evacuated from the various modular attachment slots 26, without substantially diminishing the ability of the modular attachment slot 26 to receive one or more supporting flanges 38 of the various modular components 34.

Referring again to FIGS. 2-6, due to the inclusion of the downwardly angled channels 32 of the first and second ends 80, 82 of the modular attachment slots 26, the upturned flange 28 includes chamfered portions 100 disposed at the first and second ends 80, 82 of the modular attachment slot 26. These chamfered portions 100 can provide greater accessibility to the downwardly angled channel 32 as well as the angular recesses 30 of the modular attachment slots 26 for purposes of removing debris. It is also contemplated that the chamfered portions 100 of the first and second ends 80, 82 of each of the modular attachment slots 26 can be rounded, angled, or include some other geometry. It is further contemplated that the first and second ends 80, 82 of the modular attachment slots 26 can be squared off such that each of the first and second ends 80, 82 is substantially rectangular in shape. In such an embodiment, the downwardly angled channel 32 is a substantially rectilinear channel that extends downward from the angular recess 30 of the modular attachment slot 26 to define a substantially continuous flow path. The chamfered portions 100 also form an angled transition that smoothly contours between the upturned flange 28 and the downwardly angled channels 32 such that the inner liner 18 can be formed into the appropriate shape to accommodate the various structures of the universal modular component fixing system 12 and the modular attachment slots 26 included therein. The transition provided by the chamfered portions 100 allows the inner liner 18 to be conveniently formed while maintaining structural integrity to support the various modular components 34.

Referring again to the embodiment illustrated in FIGS. 5-8, the upturned flange 28 of each of the modular attachment slots 26 can include an inner surface 110 and an outer surface 112. The inner surface 110 of the upturned flange 28 at least partially defines the angular recess 30 of the modular attachment slot 26. The outer surface 112 of the upturned flange 28 is configured to be substantially coplanar with adjacent portions of the interior surface 44 of the inner liner 18 that surround the modular attachment slot 26. In this manner, as the supporting flange 38 of one of the modular components 34 is inserted into the angular recess 30 of one of the modular attachment slots 26, the coplanar configuration of the outer surface 112 of the upturned flange 28 and the surrounding areas of the interior surface 44 of the inner liner 18 allow the abutment surface 36 of the modular component 34 to simultaneously and evenly engage the inner liner 18 and the outer surface 112 of the upturned flange 28 in a substantially flush configuration. Accordingly, when the supporting flange 38 of the modular component 34 is inserted into the angular recess 30, the engagement of the abutment surface 36 with the outer surface 112 of the upturned flange 28 and the surrounding areas of the interior surface 44 of the inner liner 18 receive at least a portion of a rotational load 114 of the modular component 34 exerted upon the structural wall 14 of the refrigerating appliance 10. In this manner, the upturned flange 28 and the inner surface 110 of the upturned flange 28 are configured to receive primarily a vertical load 116 through the engagement of the supporting flange 38 and the upturned flange 28.

Referring again to FIGS. 5-8, torque-type rotational loads 114 that are exerted upon the structural wall 14 of the refrigerating appliance 10 are primarily received by the interior surface 44 of the inner liner 18 and the outer surface 112 of the upturned flange 28. Accordingly, the torque-type rotational loads 114 that might be exerted upon the upturned flange 28, and that may tend to deflect the upturned flange 28 outward from the inner liner 18 of the refrigerating appliance 10 can be minimized. To further minimize the torque-type rotational loads 114 and individual stress points that might be exerted upon the inner surface 110 of the upturned flange 28 and other portions of the angular recess 30, the cross-sectional profile defined by the angular recess 30 is configured to substantially match the cross-sectional profile of the supporting flange 38 of the modular component 34. In this manner, the exterior surface 130 of the supporting flange 38 can be disposed in a substantially flush configuration with adjacent portions of the angular recess 30 of the modular attachment slots 26. As such, stresses exerted upon portions of the angular recess 30 via the supporting flange 38 can be evenly distributed across the inner surface 110 of the angular recess 30 and portions of the modular attachment slot 26 that engage the abutment surface 36 and supporting flange 38 of the modular component 34.

Figure 10:
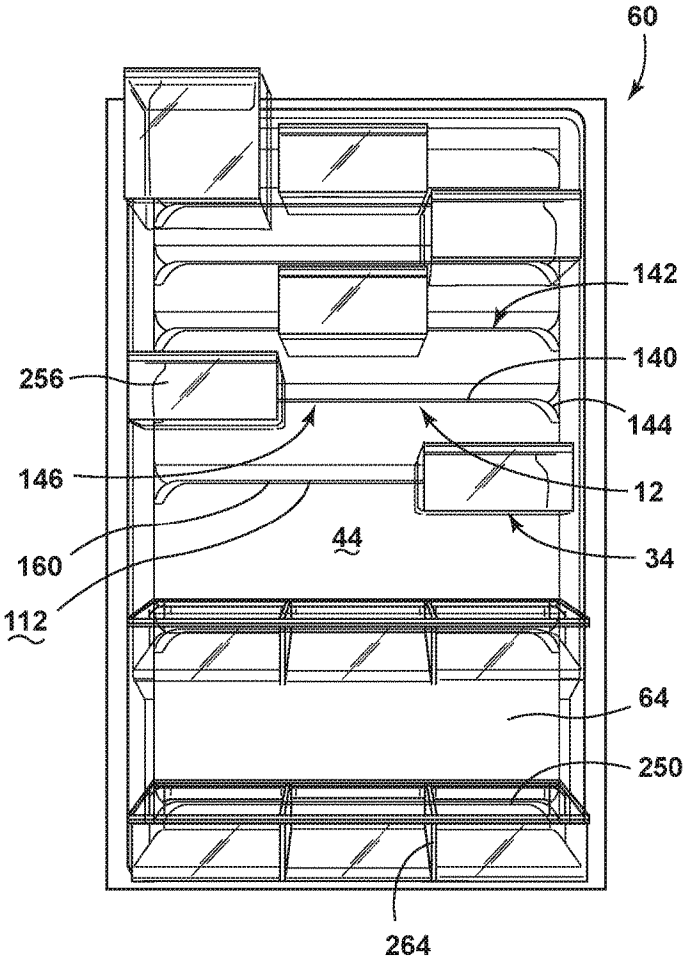
FIG. 10 is a front perspective view of the refrigerator door of FIG. 9 incorporating a plurality of modular components disposed within the plurality of modular attachment slots.
Figure 9:
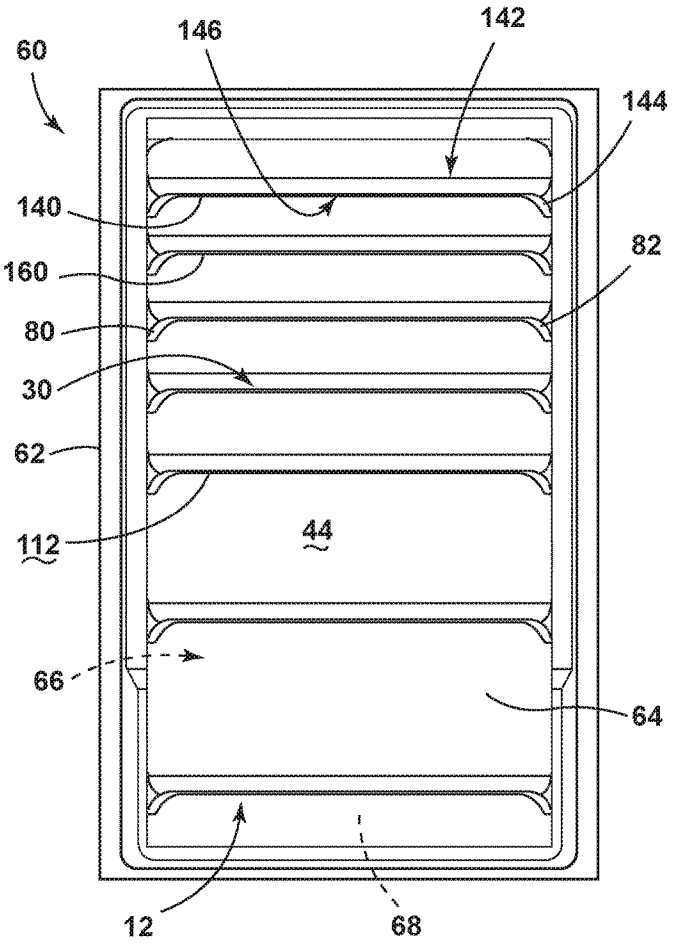
FIG. 9 is a front elevational view of an embodiment of a door for a refrigerating appliance incorporating another aspect of the universal modular component fixing system.
Figures 11, 12, 13, 14:
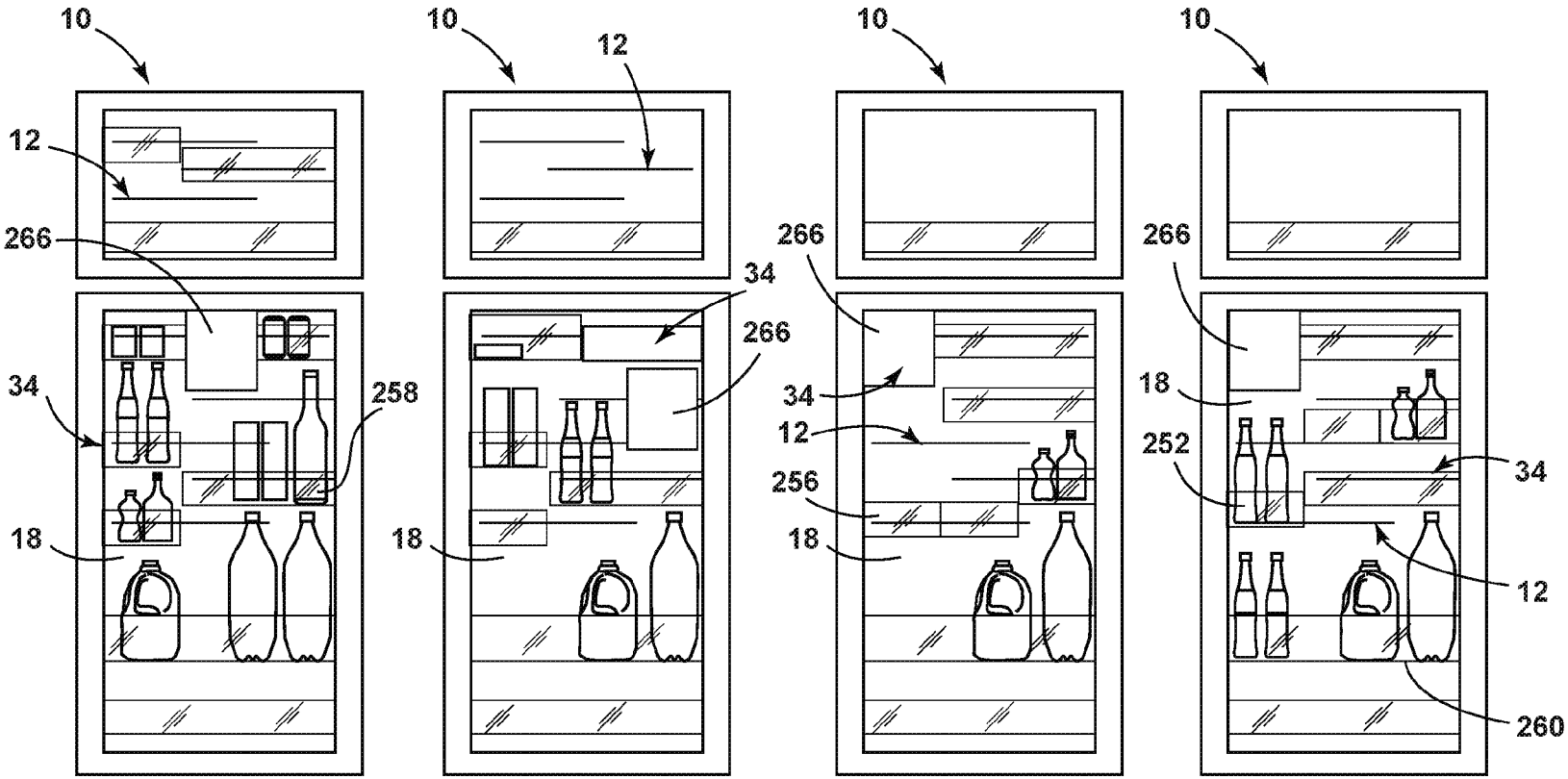
FIG. 11 is a schematic front elevation view of a refrigerating appliance incorporating another aspect of the universal modular component fixing system showing a potential arrangement of modular components within the refrigerating appliance.
FIG. 12 is a schematic front elevation view of the refrigerating appliance of FIG. 11, showing an alternate configuration of modular components.
FIG. 13 is a schematic front elevation view of the refrigerating appliance of FIG. 12, showing another alternate configuration of modular components.
FIG. 14 is a schematic front elevation view of the refrigerating appliance of FIG. 13, showing another alternate configuration of modular components.

Referring now to FIGS. 9-10, the various modular attachment slots 26 can be configured to have various geometries such that the inner liner 18 and inner door liner 64 of the refrigerating appliance 10 can include a plurality of fixing coves 140 defined within each of the inner liner 18 and inner door liner 64 that generally correspond to the modular attachment slots 26. In such an embodiment, each of the plurality of fixing coves 140 can include an inward portion 142 that defines the angular recess 30. Each of the fixing coves 140 also can include a downward drain channel 144 extending from the angular recess 30, where the downward drain channel 144 can correspond to the downwardly angled channel 32 discussed above. It is contemplated that each of the fixing coves 140, or modular attachment slots 26, can be configured to be substantially similar to one another such that each has the same internal profile along central regions 146 of the fixing coves 140 or modular attachment slots 26, and also substantially identical profiles at first and second ends 80, 82 thereof.

Referring again to the embodiments illustrated in FIGS. 1-8, it is contemplated that certain portions of the upturned flange 28 can include a reinforced portion, where the reinforced portion includes a thicker portion of the inner liner 18, or a supplemental reinforcing material disposed on an inner or outer surface 110, 112 of the inner liner 18 to provide additional structural integrity to the upturned flange 28, or another portion within or around the respective modular attachment slot 26. Such reinforced portions may be appropriate where larger modular components 34, or modular components 34 that are configured to carry substantially greater loads, are disposed within the universal modular component fixing system 12. Such modular components 34 can include larger shelves that are configured to carry larger containers of liquid, partial-width shelves 256 that may exert larger moment or torque-type rotational loads 114 upon the upturned flange 28, ice dispensing or ice manipulating modular components 34, and other similar larger load bearing modular components 34. It is also contemplated that the reinforced portion can include a strip attached to internal or external portions of the inner liner 18, or both. Such reinforcing portions can include various materials that can include, but are not limited to, plastic, ceramic, metal, combinations thereof, among other similar reinforcing-type materials.

Figure 15:
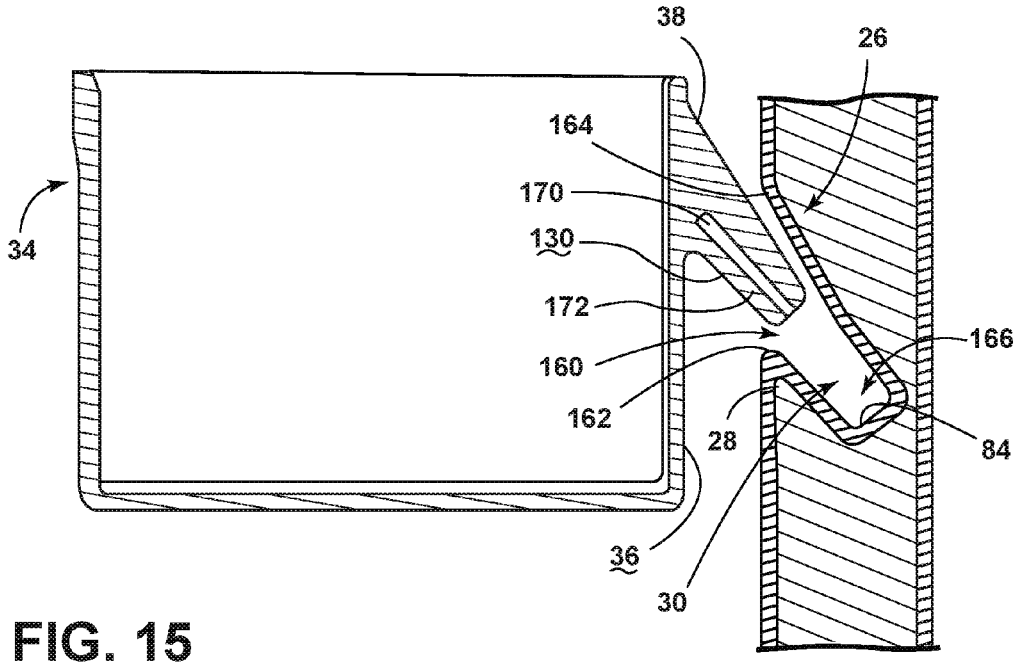
FIG. 15 is a cross-sectional view of an aspect of a modular component for the universal modular component fixing system.
Figure 16:
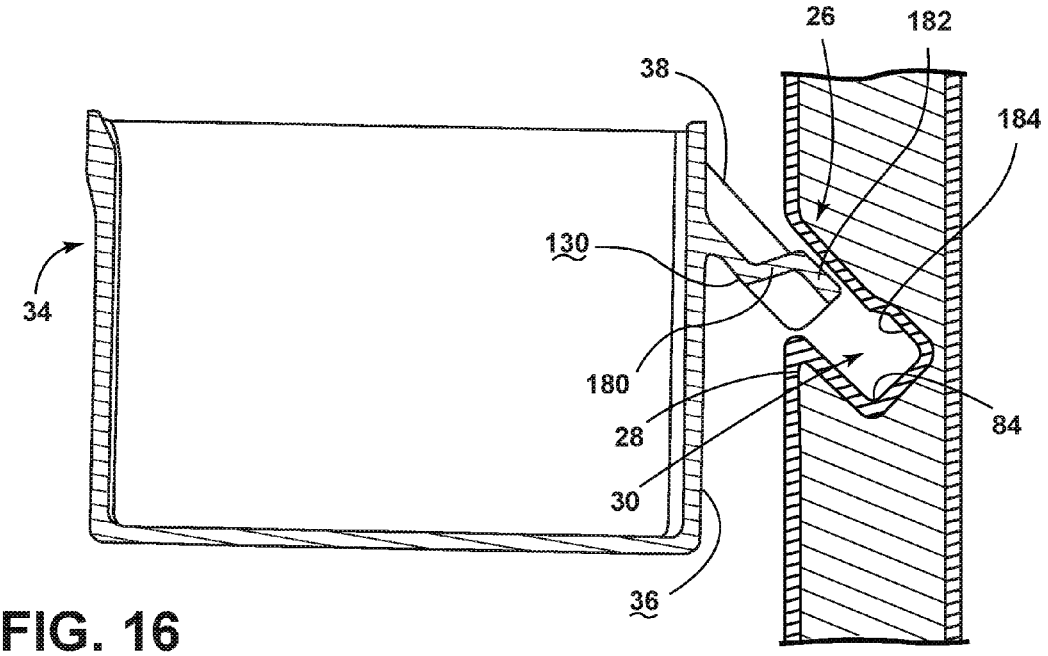
FIG. 16 is a cross-sectional view of another aspect of a modular component for the universal modular component fixing system.
Figure 17:
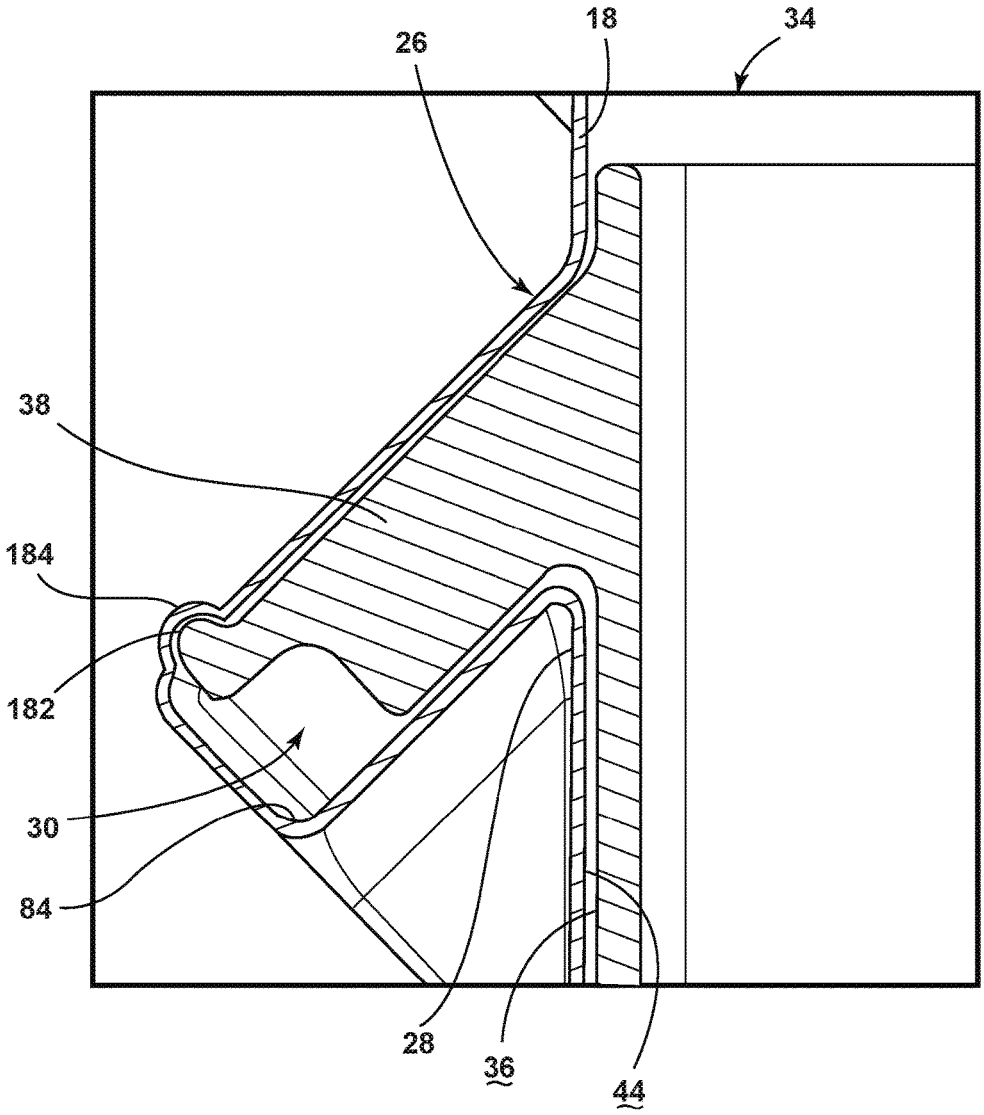
FIG. 17 is a detail cross-sectional view of another aspect of a supporting flange for a modular component of the universal modular component fixing system inserted within a corresponding modular attachment slot.

Referring now to the various embodiments illustrated in FIGS. 15-17, the cooperative configuration of the supporting flange 38 and the angular recess 30 defined by the upturned flange 28 of the modular attachment slot 26 can include various geometries and configurations, as well as various supplemental retaining features defined therein. According to one such embodiment, the angular recess 30 can include a generally tapered configuration, where the angular recess 30 narrows from a recess aperture 160 defined between an apex 162 of the upturned flange 28 and the upper boundary 164 of the modular attachment slot 26. From the recess aperture 160, the angular recess 30 generally tapers to a narrowed portion 166 toward a back portion proximate the base 84 of the angular recess 30. Similarly, in such an embodiment, the supporting flange 38 of the various modular components 34 includes a similar generally-tapered configuration that matches the shape of the tapered angular recess 30. As discussed above, the matching configuration of the supporting flange 38 and the angular recess 30 tends to evenly distribute the loads exerted upon the angular recess 30 and the modular attachment slot 26 by the modular component 34. It is contemplated that in this tapered configuration, the supporting flange 38 can be a solid member extending from the abutment surface 36 of the modular component 34.

Referring to FIG. 15, the supporting flange 38 of the modular component 34 can include a compression slot 170, or other similar cutout within the supporting flange 38. In such an embodiment, the compression slot 170 can divide the supporting flange 38 into sub-flanges 172 that oppose one another. The compression slot 170 of the supporting flange 38 can be implemented where the profile of the supporting flange 38 may be slightly less tapered, or slightly larger, than the profile of the angular recess 30. Accordingly, as the supporting flange 38 is inserted into the angular recess 30, the opposing sub-flanges 172 of the supporting flange 38 are biased inward and toward one another due to the less-tapered outer profile of the supporting flange 38 meeting the more-tapered shape of the angular recess 30. Accordingly, the sub-flanges 172 of the supporting flange 38 proximate the compression slot 170 are biased toward one another by the angular recess 30, thereby pinching the portions of the supporting flange 38 around the compression slot 170 to provide an additional retaining force exerted between the angular recess 30 and the outer surface 112 of the supporting flange 38.

Referring now to the embodiment illustrated in FIG. 16, the supporting flange 38 of the modular component 34 can include an angular supporting flange 180 that can have a smaller cross-sectional profile than that of the angular recess 30 defined by the modular attachment slot 26. In such an embodiment, the supporting flange 38 can include a retaining tab 182 having a recess latching surface that is configured to engage a retaining notch 184 having a component latching surface defined within the angular recess 30 of the modular attachment slot 26. In this embodiment, as the supporting flange 38 is inserted into the angular recess 30, the retaining tab 182 of the supporting flange 38 can be biased in a generally downward direction until such time as the retaining tab 182 of the supporting flange 38 reaches the retaining notch 184. At such an engagement point, the retaining tab 182 is biased upward and forms an interference connection, such as a removable mating engagement, between the supporting flange 38 and the retaining notch 184 of the angular recess 30. Such an interference fit can form a snap-tight connection or other similar interference connection between the supporting flange 38 and the angular recess 30.

Referring now to FIG. 17, the engagement between the angular recess 30 of the modular attachment slot 26 and the supporting flange 38 of the modular component 34 can include a combination of the previous embodiments, where the profile of the supporting flange 38 substantially matches the profile of the angular recess 30, and the supporting flange 38 and angular recess 30 include a cooperative geometry that forms an interference fit between the two engaging components. According to the various embodiments, where an interference connection is formed between the supporting flange 38 and the angular recess 30, the interference fit is configured to be strong enough to substantially retain the supporting flange 38 within the angular recess 30 to avoid inadvertent disengagement of the modular component 34 from the modular attachment slot 26. The interference connection between the supporting flange 38 and the angular recess 30 is also designed to be strong enough such that a predetermined amount of force exerted by the user can conveniently remove the modular component 34 from the modular attachment slot 26 such that the modular component 34 can be easily removed and/or relocated.

Figure 19:
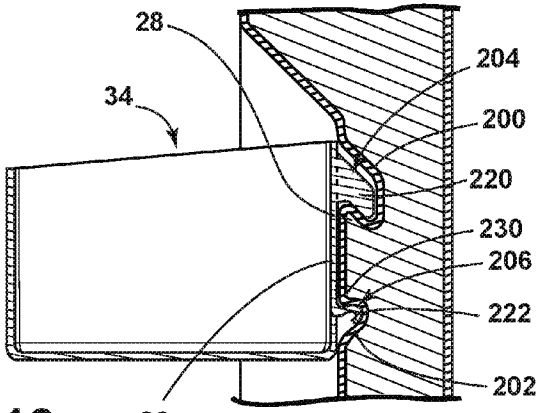
FIG. 19 is a cross-sectional view of another aspect of the universal modular component fixing system incorporating upper and lower modular attachment slots and a matching two-part support flange.
Figure 20:
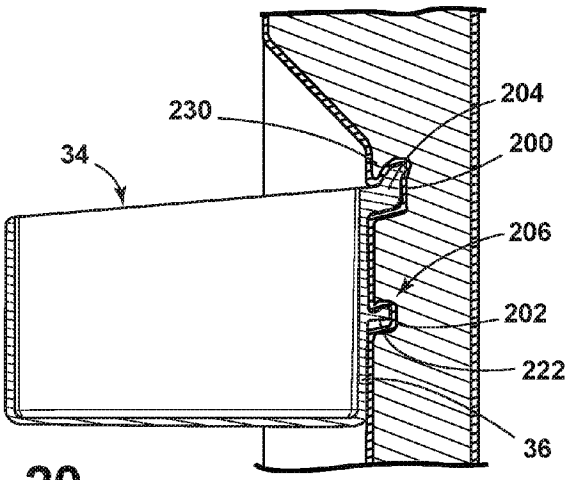
FIG. 20 is a cross-sectional view of another aspect of the universal modular component fixing system incorporating upper and lower modular attachment slots and a matching two-part support flange.
Figure 18:
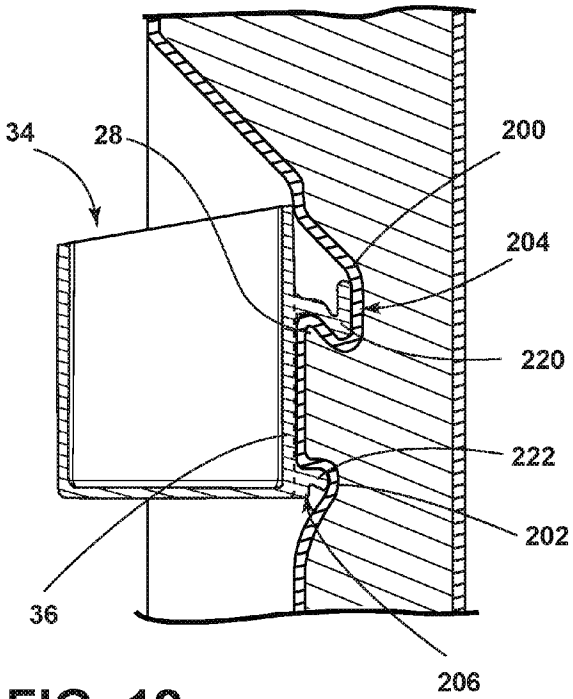
FIG. 18 is a cross-sectional view of another aspect of the universal modular component fixing system incorporating upper and lower modular attachment slots and a matching two-part support flange.
Figure 21:
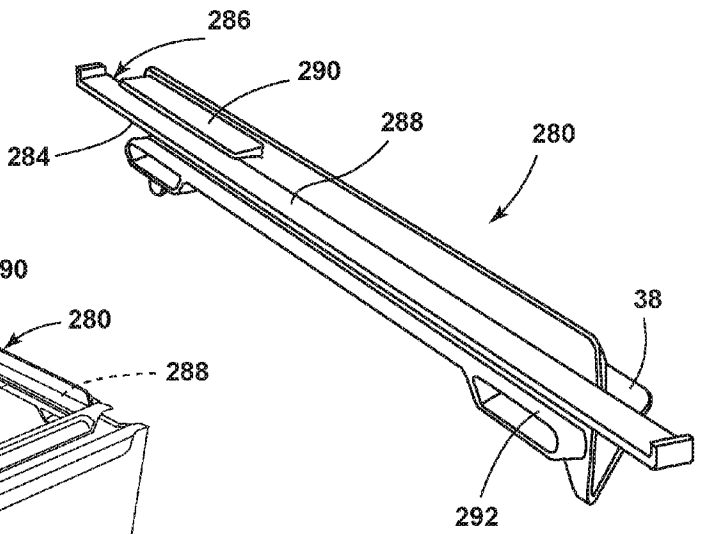
FIG. 21 is a top perspective view of a shelf bracket configured to be installed within a modular attachment slot for an aspect of the universal modular component fixing system.
Figure 22:
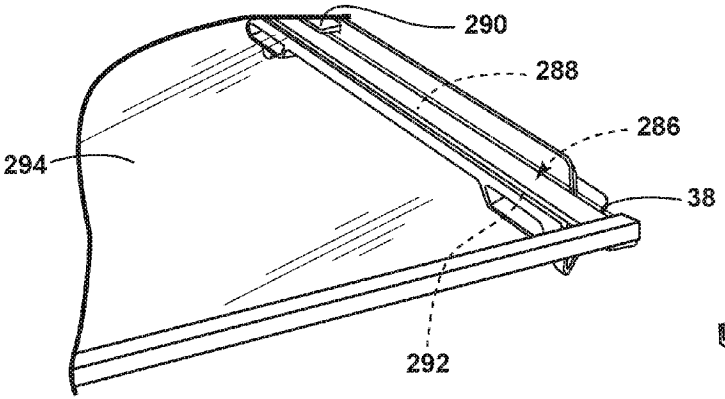
FIG. 22 is a top perspective view of a shelf member engaged with the shelf bracket of FIG. 21.
Figure 23:
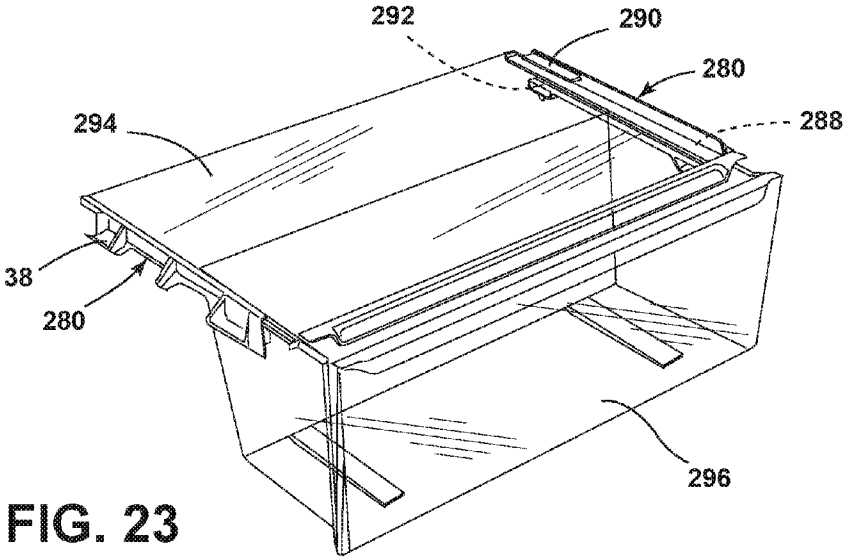
FIG. 23 is a top perspective view of a shelf/drawer combination attached with the shelf bracket of FIG. 21, according to another aspect of the universal modular component fixing system.
Figure 24:
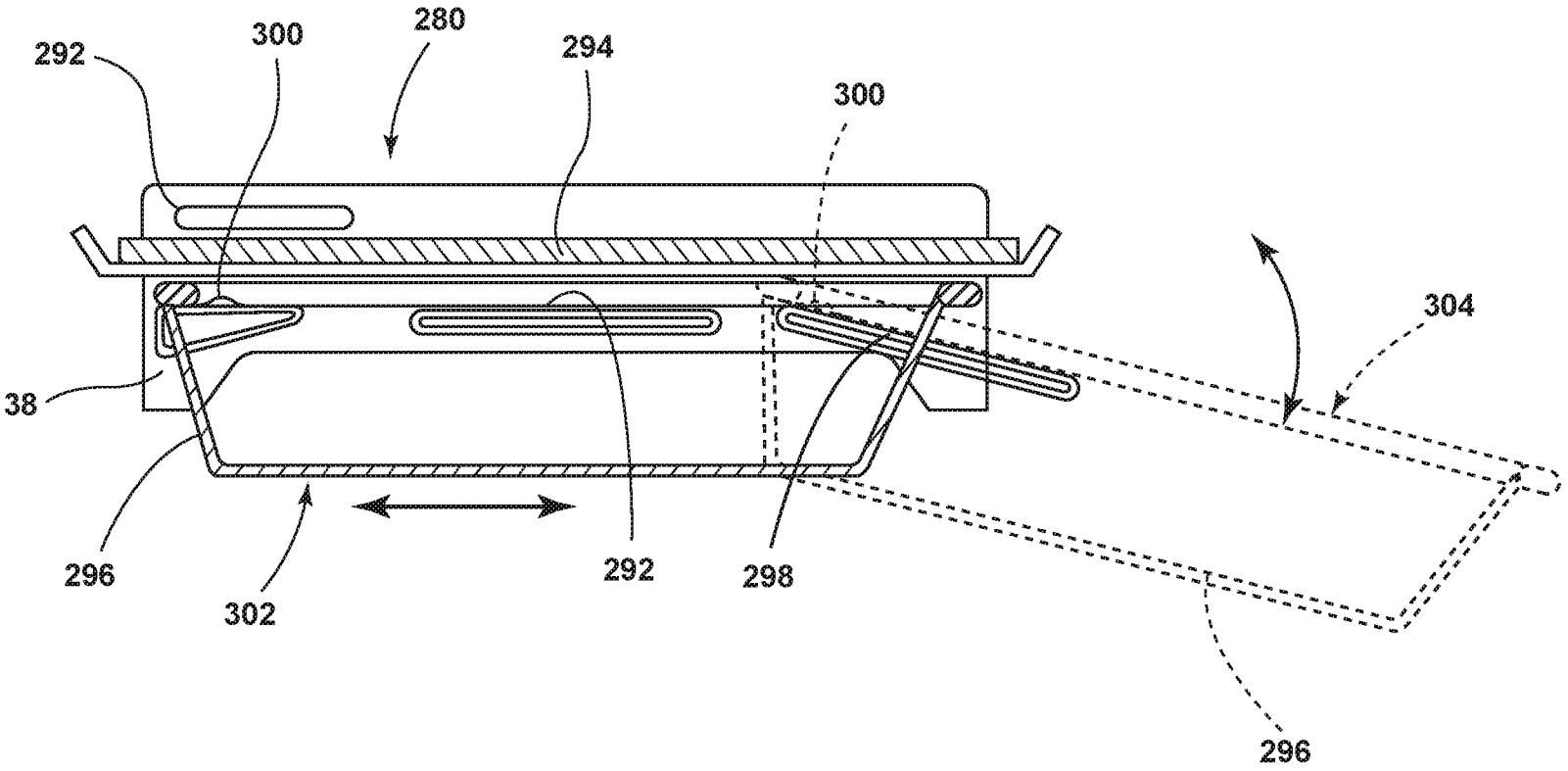
FIG. 24 is a cross-sectional view of a shelf/drawer combination attached to an aspect of the shelf bracket incorporating a tilt functionality.

Referring now to the embodiments illustrated in FIGS. 18-20, the universal modular component fixing system 12 can include a two-slot configuration where each modular attachment slot 26 includes upper and lower slots 200, 202 that receive matching upper and lower support flanges 204, 206 extending from the abutment surface 36 of the modular component 34. In such an embodiment, the upper and lower support flanges 204, 206 of the modular component 34 can cooperatively provide additional structural support for retaining the modular component 34 against the interior surface 44 of the inner liner 18 of the refrigerating appliance 10. Additionally, the use of upper and lower support flanges 204, 206 can serve to distribute the load exerted by the modular component 34 against the upper and lower slots 200, 202 so as to provide a lesser amount of deflecting force upon the respective upturned flanges 28 of each of the upper and lower slots 200, 202.

Referring now to FIG. 18, it is contemplated that the upper and lower modular attachment slots 200, 202 can be identical such that a modular component 34 having a single supporting flange 38 or matching upper and lower support flanges 204, 206 can be used within the same refrigerating appliance 10. In this embodiment, it is contemplated that the upper and lower slots 200, 202 are formed having identical cross-sectional profiles. The matching upper and lower support flanges 204, 206 of the modular component 34 may also be identical. It is also contemplated that where upper and lower slots 200, 202 are identical, that the upper and lower support flanges 204, 206 may not be identical where an upper support flange 204 includes a main supporting flange 220 and the lower support flange 206 includes a secondary supporting mechanism 222 that may have a different geometric configuration than the upper support flange 204.

Referring now to FIG. 19, it is contemplated that the upper and lower slots 200, 202 can include different configurations that are adapted to provide different supporting functionalities to the engagement between the modular component 34 and the upper and lower slots 200, 202. In this embodiment, it is contemplated that the upper slot 200 can be similar to that described above where the upper slot 200 includes the upturned flange 28 that defines the angular recess 30, and where the first and second ends 80, 82 of the upper slot 200 include the downwardly angled channels 32. The lower slot 202 of this configuration can include a downward sloping recess that defines a smaller internal volume than that defined by the angular recess 30 of the upper slot 200. Additionally, the lower slot 202 can be configured to receive a smaller secondary supporting mechanism 222 of the modular component 34.

In inserting such a modular component 34 into the upper and lower slots 200, 202, it is contemplated that the modular component 34 can be inserted at an angle such that the upper support flange 204 is inserted into the angular recess 30 of the upper slot 200, and then the modular component 34 is rotated such that the lower secondary supporting mechanism 222 engages, through an at least partial interference connection, with the lower slot 202 to retain the upper and lower support flanges 204, 206 into the respective upper and lower slots 200, 202. As discussed above with respect to the embodiment including a singular supporting flange 38, the upper support flange 204 of the modular component 34 can include a solid member having a profile that substantially matches the profile of the angular recess 30 of the upper slot 200. Alternatively, the upper support flange 204 can include a smaller outer profile that includes a retaining tab 182 that forms an interference fit between the upper support flange 204 and a retaining notch 184 in the upper slot 200.

Referring now to FIG. 20, it is contemplated that, in various embodiments, the upper and lower slots 200, 202 can include a downturned flange 230 that extends from an upper portion of the upper and lower slots 200, 202 that defines an angular recess 30 that opens in a generally downward direction. In such an embodiment, the supporting flanges 38 of the modular component 34 extend in a generally upward direction to match the orientation of the angular recess 30 defined by the downturned flange 230 of the upper and lower slots 200, 202. In this embodiment, similar to the two-supporting flange embodiments described above, the upper support flange 204 of the modular component 34 can be inserted into the upper slot 200 at an angle and then the modular component 34 can be rotated such that the lower support flange 206 can be inserted into the lower slot 202. The downturned flange 230 defines the outer surface 112 that is substantially flush with adjacent portions of the interior surface 44 of the inner liner 18 surrounding the modular attachment slots 26. Accordingly, when the modular component 34 is disposed within the upper and lower slots 200, 202, the abutment surface 36 of the modular component 34 is disposed in a substantially flush engagement with areas of the inner liner 18 surrounding the modular attachment slots 26. The inner liner 18 can then receive a substantial amount of the rotational load 114 exerted by the modular component 34 upon the inner liner 18 of the refrigerating appliance 10.

According to various embodiments, the upturned or downturned flange 28, 230 of the various modular attachment slots 26 can define convex folds defined within the inner liner 18 that extend outward from the appliance compartment, where each of the convex folds defines the angular recess 30 that extends outward toward the outer wrapper 16 from a recess aperture 160 defined by the interior surface 44 of the inner liner 18. Accordingly, the angular recess 30 is placed in communication with the interior volume 24 of the refrigerating appliance 10 through the recess aperture 160. Additionally, it is contemplated that each of the convex folds can also include a downward extending surface that extends downward from an outermost portion or base 84 of the angular recess 30 towards the recess aperture 160. It is contemplated that such downwardly extending surfaces can correspond to the downwardly angled channels 32 described above.

According to various embodiments, it is contemplated that in embodiments including one or two supporting flanges 38, the supporting flanges 38 can be configured to extend across the entire modular component 34. Alternatively, the various supporting flanges 38 of the modular component 34 can extend across only a portion of the abutment surface 36 of the modular component 34. It is also contemplated that a supporting flange 38 can include several smaller supporting flanges 38 that extend across the abutment surface 36 of the modular component 34 such that numerous smaller individual supporting flanges 38 can be implemented. In embodiments where the abutment surface 36 includes upper and lower support flanges 204, 206, it is contemplated that one of the upper and lower support flanges 204, 206 can extend along the entire length of the abutment surface 36 or substantially the entire length of the abutment surface 36, and the other of the upper and lower support flanges 204, 206 can be broken up into individual smaller supporting flanges 38 or a single smaller supporting flange 38 disposed on the abutment surface 36 of the modular component 34.

According to the various embodiments, while the fixing coves 140 or modular attachment slots 26 may have different lengths, common cross sections taken at central regions 146 of any one fixing cove 140 or modular attachment slot 26 will be substantially identical to other corresponding cross sections taken at any other modular attachment slot 26. Similarly, a section taken through a first or second end 80, 82 of any one fixing cove 140 or modular attachment slot 26 will substantially match a corresponding section through any other first or second end 80, 82 of a different modular attachment slot 26 or fixing cove 140 within the refrigerating appliance 10. In this manner, the universal modular component fixing system 12 includes a singular attachment method defined by the fixing coves 140 or modular attachment slots 26 that are adapted to receive a matching supporting flange 38 of any one or more of a plurality of modular components 34 for the universal modular component fixing system 12. As such, a modular component 34 can be disposed within substantially any fixing cove 140 or modular attachment slot 26 within the refrigerating appliance 10. This interchangeability of the various modular components 34 is due to the matching configuration of each of the supporting flanges 38 of all of the modular components 34 and the similarly matching configuration of each of the fixing coves 140 or modular attachment slots 26 of the universal modular component fixing system 12.

Referring now to FIGS. 4 and 10-14, the modular components 34 for the universal modular component fixing system 12 can include any one of several different types of modular components 34. These modular components 34 can include, but are not limited to, crisper drawers 250, wire trays, bottle holders 252, ice dispensers 254, partial-width drawers 256, full-width drawers, partial and full width shelves 258, 260, product hangers 262, container holding bins, water tanks, medicine bins, dairy bins, Tupperware®-type storage bins that can be inserted into and stored within a larger Tupperware®-holding structure, water pitchers 320, water filling stations, bin dividers 264, egg holders, product dispensers, shelf brackets, soft produce mats, rolling produce mats, partial width and full width meat or produce pans, fast chillers 266, individual storage bins having a larger primary docking station, ice forming trays and twistable ice dispensing trays, shelf/drawer combination units 268, along with other similar modular components 34 having varying functionalities.

As further illustrated in FIGS. 4 and 10-14, a user can use these various modular components 34 to set up a variety of configurations for the refrigerating appliance 10. At any time, the user can rearrange the modular components 34, acquire additional modular components 34, replace modular components 34 and dispose one or more of the modular components 34 within the universal modular component fixing system 12, according to the particular needs of a user at any given time. By way of explanation, and not limitation, where a user requires a plurality of smaller bins for containing large varieties of meat, produce, and other refrigerated items, the user can include a plurality of smaller bins throughout various portions of the universal modular component fixing system 12 to account for storage of such numerous varieties of refrigerated items. If the user subsequently requires larger amounts of space for larger refrigerated items such as large produce, food trays, and the like, the user can rearrange or replace certain modular components 34 within the universal modular component fixing system 12 to account for such functionality. Because each of the modular attachment slots 26 is similar in profile and each of the matching supporting flanges 38 of the various modular components 34 are also matching in profile, any one modular component 34 can be disposed in any of the modular attachment slots 26, so long as the dimensional parameters of the various modular components 34 can be accommodated by the size available within the interior volume 24 of the refrigerating appliance 10.

According to various embodiments, it is contemplated that a refrigerating appliance 10 can include a utility storage compartment defined within a portion of the refrigerating appliance 10 for storage of unused modular components 34, such as a component storage bin disposed on top of the refrigerating appliance 10 or behind the refrigerating appliance 10. In this manner, modular components 34 can be stored within close proximity of the refrigerating appliance 10 for later use. Such storage of modular components 34 can be accomplished by hooks, shelving, and other various storage mechanisms.

Referring now to the embodiment illustrated in FIGS. 21-24, one such modular component 34 can include a shelving bracket 280 that includes an outside edge 282 that includes the supporting flange 38 that can be engaged into the angular recess 30 of one of the modular attachment slots 26. An inside edge 284 of the shelving bracket 280 can include a shelf-receiving slot 286 that includes a bottom supporting surface 288 and an upper retaining tab 290 such that a shelving unit 294 can be disposed between the bottom supporting surface 288 and the upper retaining tab 290 to substantially retain the shelf within the shelving bracket 280. It is contemplated that the shelving bracket 280, in order to retain a shelf in a predetermined position within the universal modular component fixing system 12, should include opposing shelving brackets 280 on either side of the shelving unit 294. It is contemplated that various shelving modular components 34 can include a single bracket where the shelf member is cantilevered from the shelving bracket 280 into a central portion of the interior volume 24 of the refrigerating appliance 10. Such cantilevered shelves can include quarter-width shelves, third-width shelves or other partial-width shelves 258 that extend across only a portion of the refrigerating appliance 10.

Referring again to FIGS. 21-24, it is contemplated that the shelving bracket 280 can retain either a shelf between opposing shelving brackets 280 or a shelf/drawer combination unit 268. Where a shelf/drawer combination unit 268 is included, the shelving bracket 280 can include an integrated drawer slide 292 within a portion of the shelving bracket 280 that defines a sliding position 302 of the drawer 296, where the drawer 296 can be laterally moved between open and closed positions. In this embodiment, one upper portion of the shelving bracket 280 can be configured to support the shelving unit 294 and a lower portion of the shelving bracket 280 can be configured to support one or more drawers 296 in the sliding position 302 such that the drawers 296 are operable between open and closed positions. According to various embodiments, the drawer slide portion of the various shelving brackets 280 can include a tilting member 298 defined within a portion of the shelving bracket 280 such that a drawer 296 can be withdrawn from the integrated drawer slide 292 a certain distance, to a point where a portion of the drawer 296 reaches the tilting member 298 of the various shelving brackets 280 that support the drawer 296. The tilting member 298 of the shelving bracket 280 can be configured to allow the drawer 296 to be in a tilting position 304 where the drawer 296 can be tilted downward a predetermined distance such that the user can be afforded a larger aperture through which to reach into the drawer 296 to place, remove or rearrange items within the drawer 296. The drawer 296 can include a tilting stop 300 for preventing the drawer 296 from tilting too far and pivotally overturning.

Figure 25:
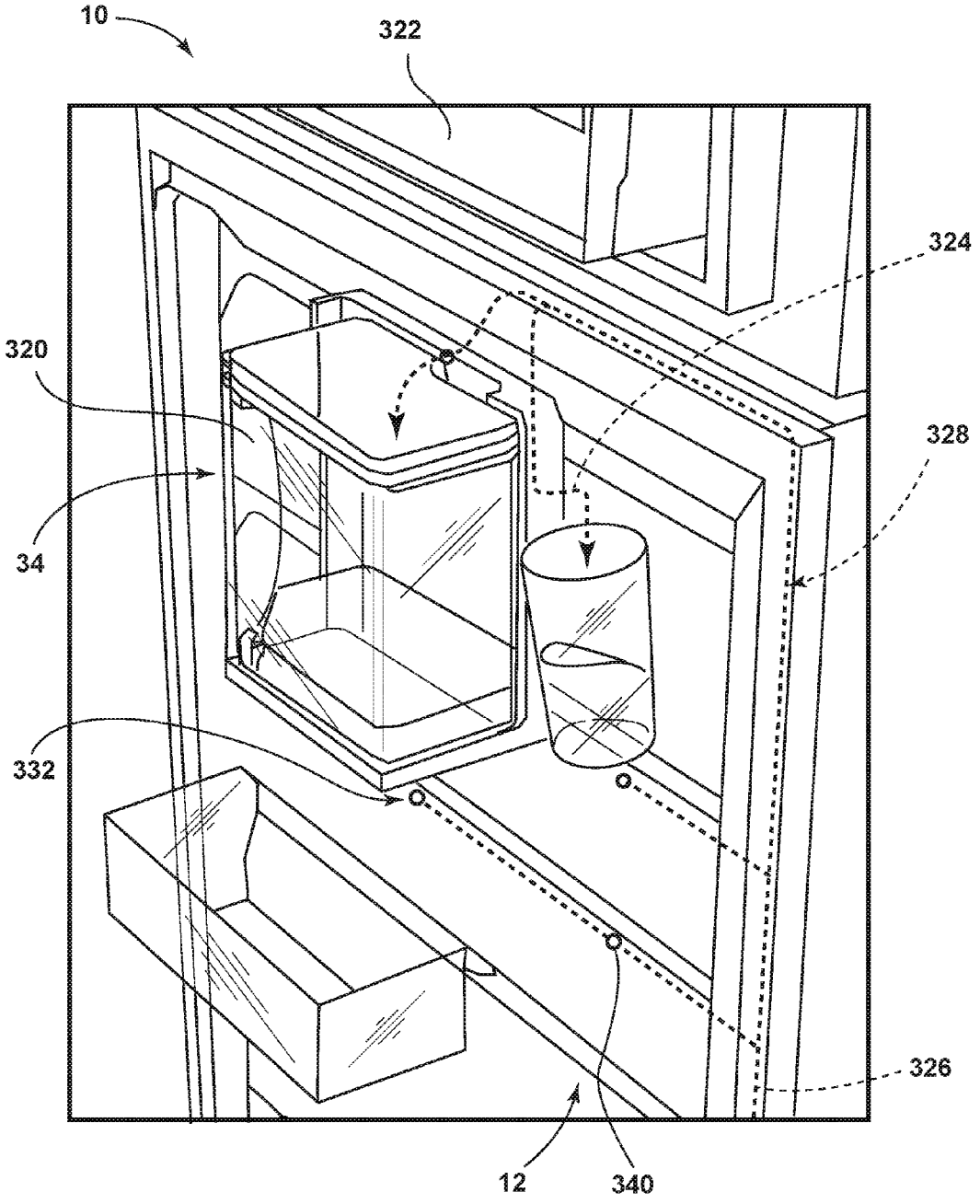
FIG. 25 is a detail perspective view of an aspect of the universal modular component fixing system incorporating a water delivery system within the modular attachment slots.
Figure 26:
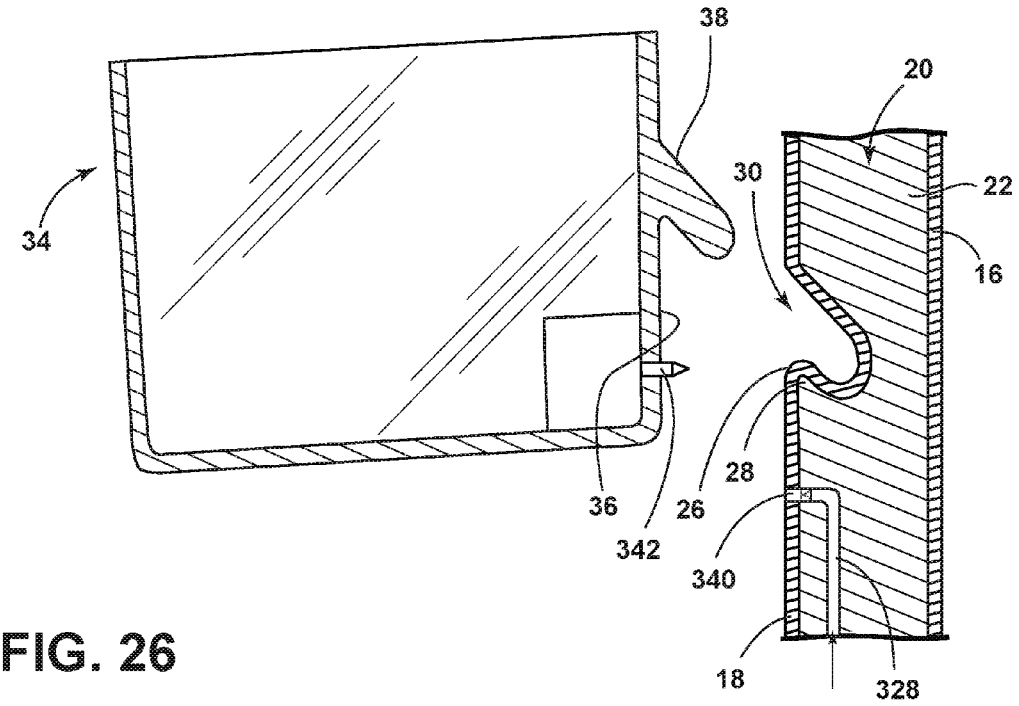
FIG. 26 is a cross-sectional view of the aspects of FIG. 25 showing the modular component having a water utility receptacle about to be connected with a modular attachment slot having a water utility port.

Referring now to FIGS. 25-26, according to various embodiments, certain modular components 34 can include water dispensing or ice forming and/or dispensing features, such as an integrated water pitcher 320, ice maker 322, ice dispenser 254, water dispenser 324 and other similar modular components 34. In such embodiments, it is contemplated that a water delivery system 326 of the refrigerating appliance 10 can include at least one water line 328 that is run to a portion of one or more of the modular attachment slots 26. Accordingly, the refrigerating appliance 10 can include a utility system, such as an electrical system, a water delivery system 326 or a chilled air delivery system 330 that is disposed at least partially within the insulated cavity defined between the inner liner 18 and the outer wrapper 16 of the refrigerating appliance 10. The utility system, in such an embodiment, includes a plurality of utility ports 332 that are in communication with the utility system, wherein each of the utility ports 332 is disposed within at least one of the modular attachment slots 26 proximate the angular recess 30 defined therein. Accordingly, when a powered modular component 34, such as a modular component 34 that incorporates a water or chilled air functionality, is installed within the corresponding modular attachment slot 26 that includes the utility port connected with the utility system of a refrigerating appliance 10, the utility system of the refrigerating appliance 10 is placed in communication with the powered modular component 34 via the engagement of the modular component 34 and the utility port disposed within the angular recess 30 of the modular attachment slot 26. The utility ports 332 can include refrigeration ports, electrical ports, water ports, chilled air ports, combination ports and other similar ports for connecting to the various utility systems of the appliance 10.

In the various embodiments disclosed above, it is contemplated that the universal modular component fixing system 12 includes only a predetermined number of utility ports 332 such that the various powered modular components 34, in order to be placed in communication with the utility system, must be placed in a predetermined set of locations in order to be placed in such communication. In the various embodiments, it is contemplated that the utility ports 332 can generally be placed in a spaced configuration throughout the interior of the refrigerating appliance 10 such that the various powered modular components 34 can be selectively moved throughout portions of the interior volume 24 of the refrigerating appliance 10. Accordingly, the modular and adjustable functionality of the universal modular component fixing system 12 maintains the flexibility to modify the location of the various modular components 34, whether powered or static.

Figure 27:
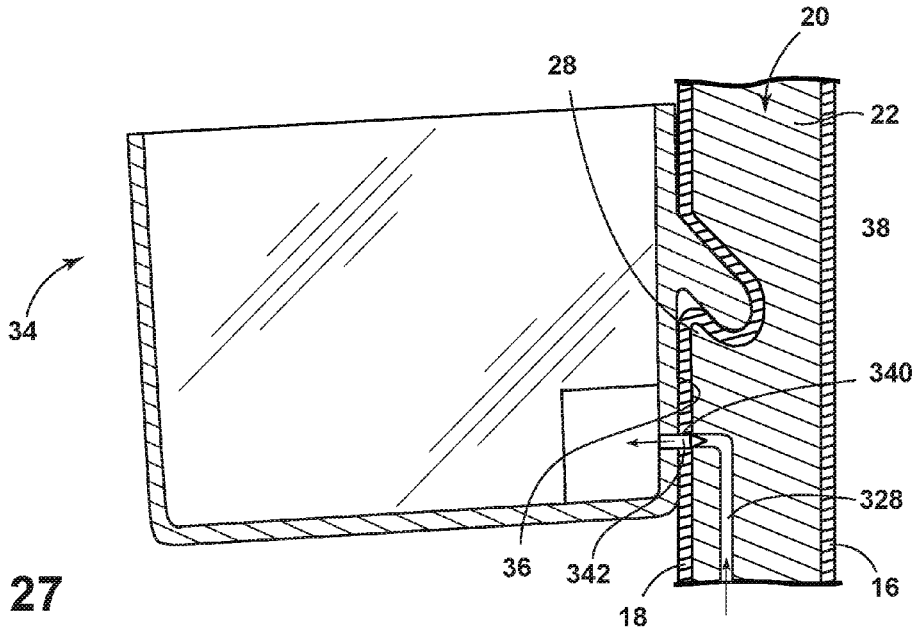
FIG. 27 is a cross-sectional view of the modular attachment slot of FIG. 26 showing the water utility receptacle and water utility port connected so that the modular component is in communication with the water system of the refrigerating appliance.

Referring again to FIGS. 25-27, the utility system of the refrigerating appliance 10 can include water lines 328 that run through the insulating cavity 20 of the refrigerating appliance 10 between the inner liner 18 and the outer wrapper 16, at least one of these lines can be run to various utility ports 332 defined within one or more water utility ports 340 of the plurality of modular attachment slots, such that a water functionality can be delivered to one or more water utility ports 340 of the plurality of utility ports 332. In such an embodiment, it is contemplated that each water utility port 340 can be disposed either within the modular attachment slot 26 proximate the angular recess 30 or can be disposed adjacent to the modular attachment slot 26 on a portion of the inner liner 18 proximate thereto. In such embodiments, it is contemplated that the modular component 34 can include a water utility receptacle 342 that engages the water utility port 340. Where the water utility port 340 is disposed within the angular recess 30, the utility receptacle can be disposed on a portion of the supporting flange 38 of the modular component 34. In this manner, when the supporting flange 38 is disposed within the appropriate portion of the angular recess 30, the water utility receptacle 342 of the utility support flange engages the water utility port 340 disposed within the angular recess 30 to place the modular component 34 in communication with the water lines 328 of the refrigerating appliance 10. It is also contemplated that the water utility receptacle 342 of the modular component 34 can be disposed along or with a portion of the abutment surface 36 of the modular component 34, such that when the abutment surface 36 of the modular component 34 engages a portion of the inner liner 18 proximate the modular attachment slot 26, the connection of the water utility receptacle 342 on the abutment surface 36 with the water utility port 340, places the modular component 34 in communication with the water lines 328 of the refrigerating appliance 10.

Figure 28:
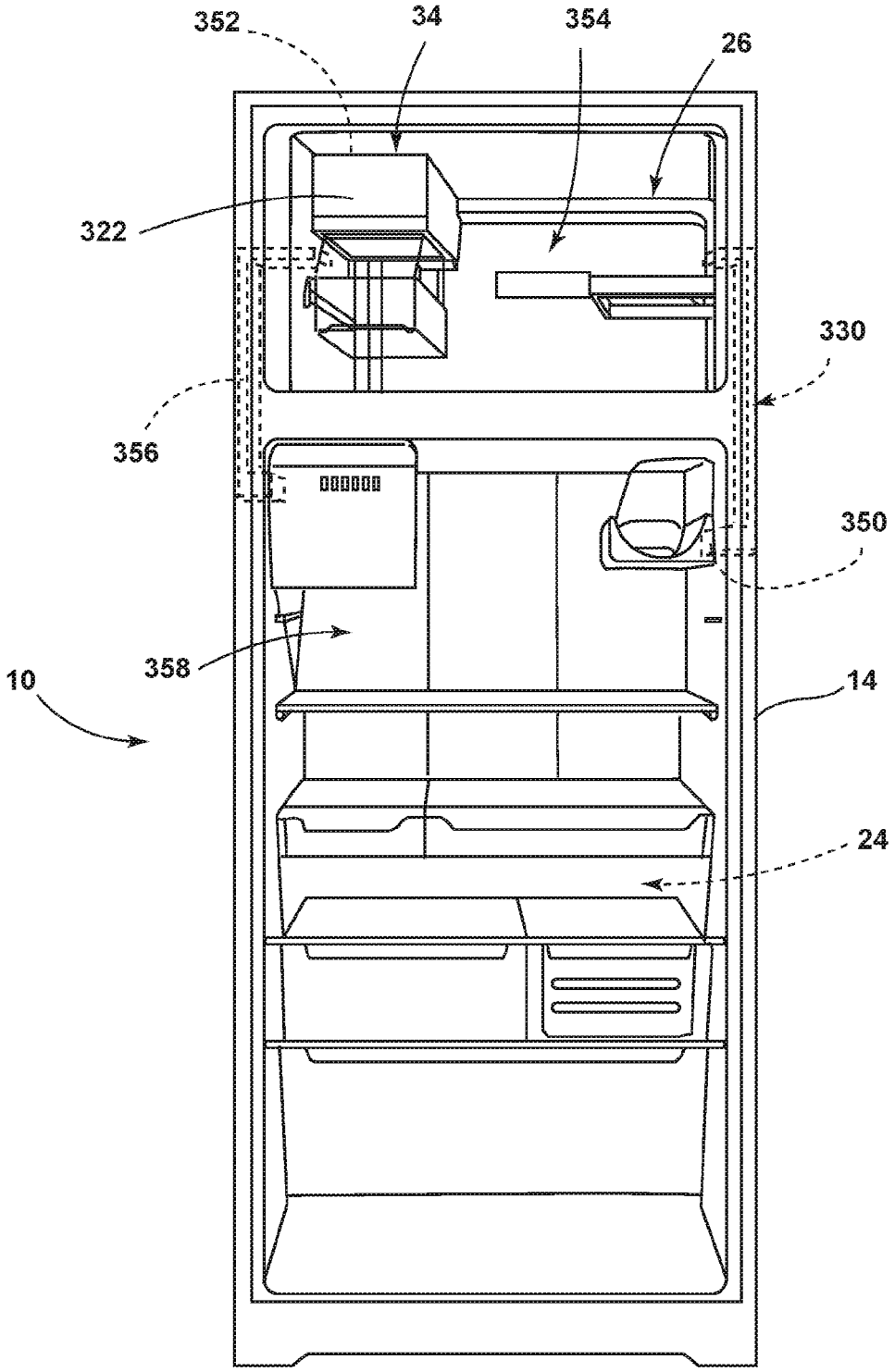
FIG. 28 is a front perspective view of a refrigerating appliance incorporating another aspect of the universal modular component fixing system having an air handling system incorporated within a portion of the modular attachment slots of the universal modular component fixing system.

Referring now to FIG. 28, in addition to water utility ports 340, chilled air supplying utility ports 332 can also be disposed in various portions of the refrigerator compartment 358 where the chilled air utility ports 350 are in communication with the chilled air delivery system 330 that can include either the refrigeration system 352 of the refrigerating appliance 10 or a portion of the freezer compartment 354, or both, such that cooled air, being colder than the air typically delivered to the refrigerator compartment 358, can be delivered through the chilled air utility ports 350 into certain powered modular components 34 that implement the use of chilled air to provide various chilling functionalities. Such chilled air powered modular components 34 can include an ice maker 322, a quick freeze modular component 34, and various other modular components 34 that incorporate a chilling functionality. The chilled air utility ports 350 can be attached to chilled air conduits 356 that extend through at least a portion of the insulating cavity 20 of the refrigerator compartment 358 between the inner liner 18 and outer wrapper 16. As discussed above, the chilled air conduits 356 can extend to at least a portion of the freezer compartment 354 or can be run to a portion of the refrigeration system 352 of the refrigerating appliance 10. The chilled air conduits 356 can include one or more fans or other air handling mechanisms for pushing, pulling or otherwise moving chilled air from the refrigeration system 352 or freezer compartment 354 toward the chilled air utility ports 350 disposed within a portion of the refrigerator compartment 358. As discussed above with respect to the other utility ports 332, the chilled air utility ports 350 can be similarly located within a portion of the angular recess 30 defined by the modular attachment slots 26, or can be disposed within a portion of the inner liner 18 proximate the modular attachment slot 26.

Figure 29:
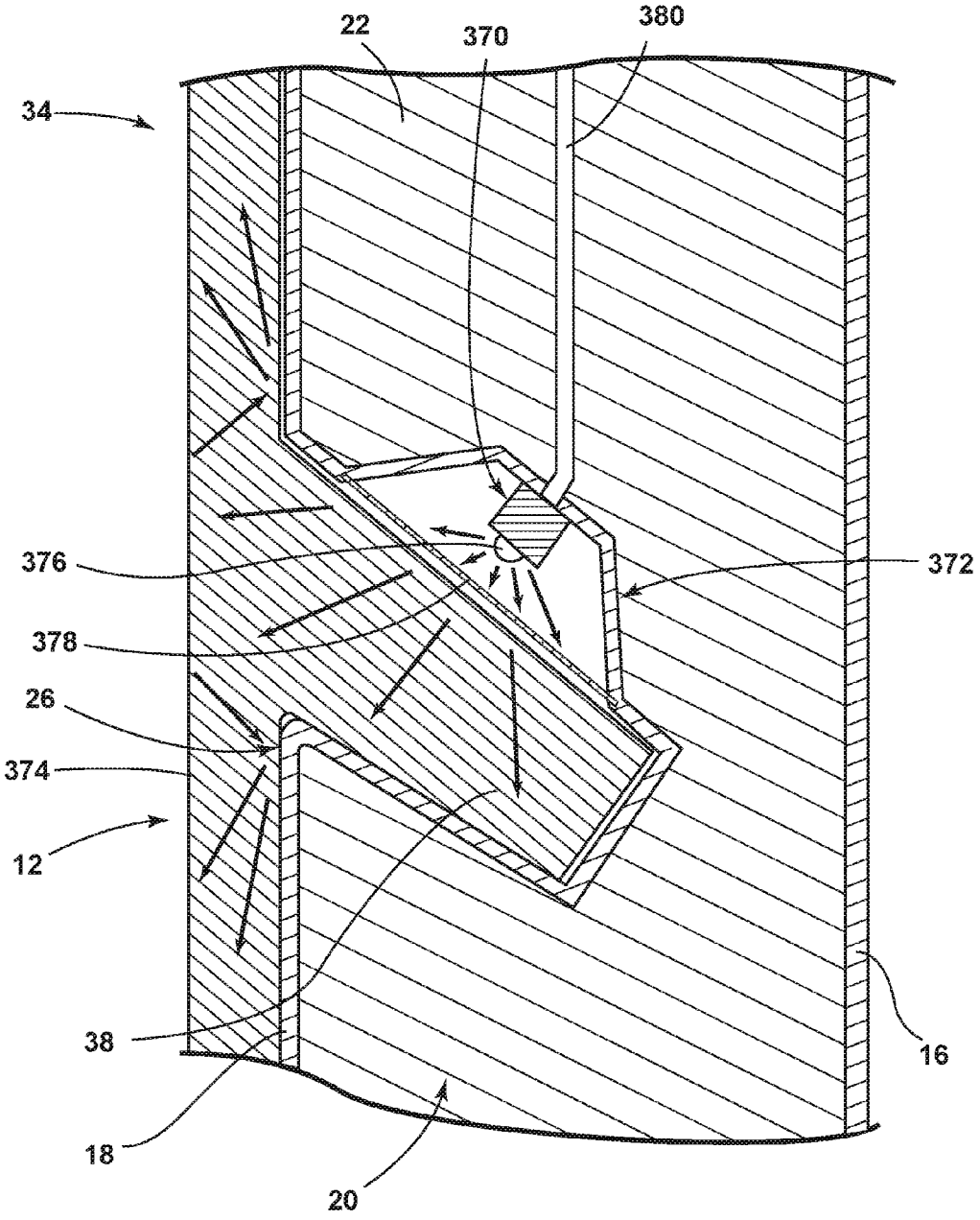
FIG. 29 is a detail cross-sectional view of a modular attachment slot of an aspect of the universal modular component fixing system incorporating a lighting fixture.
Figure 30:
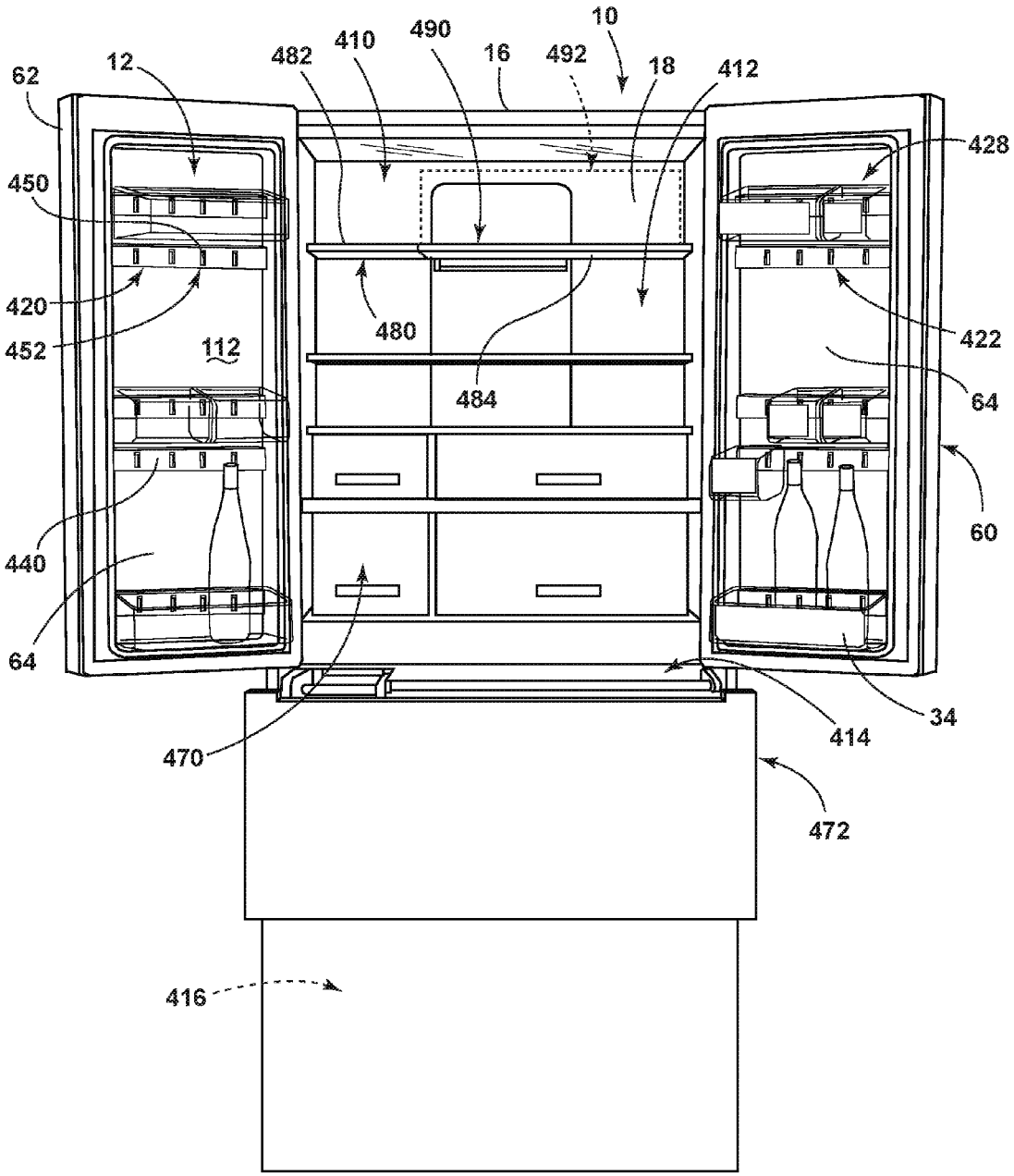
FIG. 30 is a front elevational view of an aspect of the universal modular component fixing system incorporating a modular bin system within the inner liner of the appliance.
Figure 31:
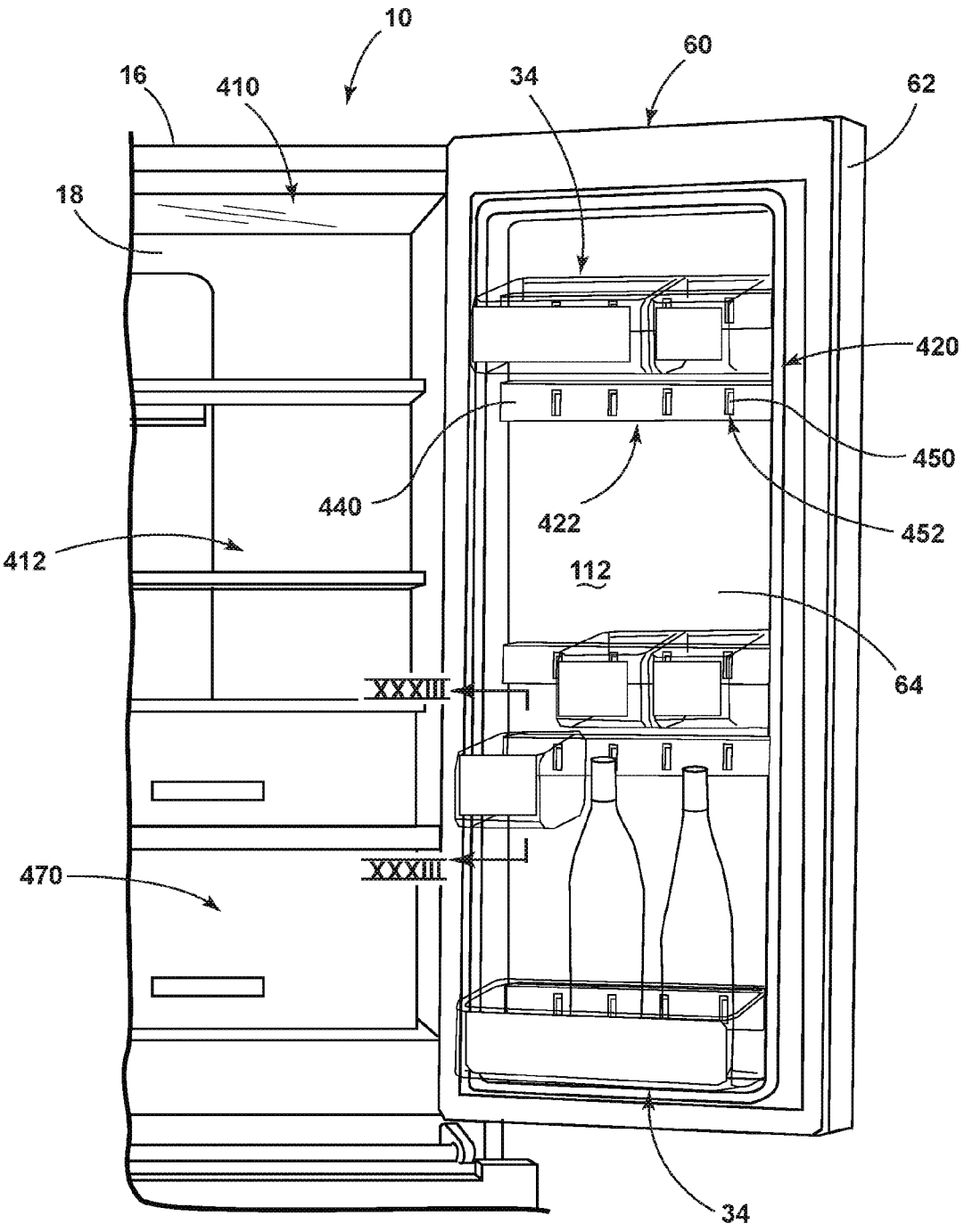
FIG. 31 is an enlarged elevational view of the appliance of FIG. 30.

Referring now to FIG. 29, it is contemplated that various modular attachment slots 26 of the universal modular component fixing system 12 can include a lighting fixture 370 or other lighting mechanism disposed proximate the angular recess 30. In such an embodiment, the lighting fixture 370 is adapted to at least partially illuminate one or more at least partially translucent or transparent modular components 34. The modular components 34 that can be so illuminated are generally translucent or transparent in configuration to allow light to transfer from the lighting fixture 370 disposed in a lighting recess 372 proximate the angular recess 30 to be spread throughout the translucent or transparent illuminating walls 374 of the modular component 34. It is contemplated that the lighting fixture 370 disposed within the angular recess 30 can include a light, such as a light emitting diode (LED) light 376, fluorescent light, or other similar light fixture that is disposed within the angular recess 30. The lighting fixture 370 can be powered through electrical wiring 380 that is run through the insulating cavity 20 from an electrical distribution system of the refrigerating appliance 10 to a switch for controlling the operation of the lighting fixture 370 and to the lighting fixture 370 itself. The lighting fixture 370 should generally be small enough such that it is capable of being installed within the lighting recess 372 proximate the modular attachment slot 26 and, in some embodiments, within the insulating cavity 20. It is contemplated that at least a portion of the modular attachment slot 26 proximate the angular recess 30 includes a lens 378 for transferring light from the light fixture into the angular recess 30 and into the illuminating walls 374 of the modular component 34 that is at least partially translucent. The lens 378 can be configured to be removable so that the lighting fixture 370 can be accessed for repair or replacement. It is also contemplated that the light fixture can be disposed within a wall of the inner liner 18, such that when a modular component 34 is inserted into the modular attachment slot 26, the lighting fixture 370 can spread light through the abutment surface 36 of the modular component 34 and through the illuminating walls 374 of the modular component 34 to illuminate the modular component 34 and surrounding areas within the refrigerating appliance 10. Additionally, where the lighting fixture 370 is disposed within the inner liner 18 proximate the modular attachment slot 26 or within the modular attachment slot 26, the various lighting fixtures 370 so disposed can be used to illuminate portions of the refrigerator and freezer compartments 354, 358 of the refrigerating appliance 10 even when the modular component 34 is not disposed proximate the various light fixtures. The various lighting fixtures 370 can be configured such that the lighting fixture 370 turns on only when a modular component 34 is disposed proximate the various lighting fixtures 370, according to some aspects, such that the lighting fixtures 370 are only used when they can serve to illuminate a modular component 34. Various user controls can also be implemented to turn on or turn off various lighting fixtures 370 within the various portions of the universal modular component fixing system 12 to selectively turn on or turn off at least a portion of the lighting fixtures 370 within the refrigerating appliance 10.

Referring now to FIGS. 30-37, another aspect of the modular component fixing system 12 is exemplified, where the modular component fixing system 12 is attached to the inner liner 18 of the refrigerating appliance 10. The inner liner 18 of the refrigerating appliance 10 defining at least one refrigerating compartment 410, the various refrigerating compartments 410 including, but not limited to, a refrigerated compartment 412, pantry compartment 414, freezing compartment 416, warming compartment, combinations thereof, and other similar refrigerating compartments 410 of an appliance. The modular component fixing system 12 can include a modular bin system 420 for the refrigerating appliance 10 that includes at least one fixing bar 422 attached to the inner liner 18 and extending through a portion of the refrigerating compartment 410. A cleat receptacle 424 is defined between the inner liner 18 and the at least one fixing bar 422. It is contemplated that the cleat receptacle 424 can be defined between the outer surface 110 of the inner liner 18 and the rearward facing surface of each of the fixing bars 422 of the modular bin system 420. The modular bin system 420 can also include a plurality of modular components 34, where each of the modular components 34 includes an abutment surface 36 and a cleat member 426 that extends from the abutment surface 36 of each of the modular components 34. According to the various components of the modular bin system 420, each of the modular components 34 is configured to be removably engaged with the various fixing bars 422 of the modular bin system 420 to define a secured position 428. In the secured position 428, the abutment surface 36 of the modular component 34 engages a front portion 430 of the fixing bar 422 and the cleat member 426 is received within the cleat receptacle 424. In this manner, the abutment surface 36 of the modular component 34 and the cleat member 426 are positioned to hang from the fixing bar 422. Additionally, the abutment surface 36 of the modular component 34 rests against the front portion 430 of the fixing bar 422 and the cleat member 426 rests against the outer surface 112 of the inner liner 18 to substantially prevent rotational movement of the modular component 34 when in the secured position 428. It is contemplated that the cleat member 426 can also define a supporting flange 432 that extends substantially downward and is wedged or is held in place between the inner liner 18 and the fixing bar 422. These various engagements between the modular component 34, the fixing bar 422 and the inner liner 18 serve to define the secured position 428 as the modular component 34 rests on the fixing bar 422.

According to the various embodiments, the fixing bar 422 can include a cover member 440 and a structural bar 442, wherein the cover member 440 is selectively removable from the structural bar 442. It is contemplated that the cover member 440 can include any one of various finishes, textures, or other conditioned surfaces that provide an aesthetic appearance that can serve to conceal, at least partially, the structural bar 442 of the fixing bar 422. According to the various embodiments, it is contemplated that the cover member 440 can be one of a plurality of cover members 440 that can be interchangeable as part of the modular bin system 420. In such an embodiment, various sets of cover members 440 can be provided. Each set of cover members 440 can include a different exterior finish or aesthetic appearance including various finishes, textures, colors, combinations thereof and other aesthetic features. It is contemplated that depending upon the desires of the user, each set of cover members 440 can be interchanged onto the structural bar 442 to provide a different aesthetic appearance for the refrigerating appliance 10 and the refrigerating compartment 410 within the refrigerating appliance 10. Such aesthetic features can include, but are not limited to, wood tones, various colors, textures, graphical indicia, text, translucent and/or transparent features, combinations thereof, and other similar aesthetic finishes. It is contemplated that the cover members 440 can be made of various materials, where such materials can include, but are not limited to, wood, plastic, metal, rubber, glass, ceramic, polymers, combinations thereof and other similar materials.

According to the various embodiments, it is also contemplated that the cover member 440 can be affixed to the structural bar 442 such that the cover member 440 finish is determined during manufacture of the refrigerating appliance 10.

It is also contemplated that where the cover member 440 is removable from the structural bar 442, various securing features can be defined by the cover member 440 and the structural bar 442. Such securing members can include, but are not limited to, matingly engaging features such as mating protrusions and/or protrusion/recess combinations, hooks, hasps, clasps, detents, hook-and-loop connectors, magnetic connectors, combinations thereof, and other similar securing features.

It is also contemplated that the various fixing bars 422 of the modular bin system 420 are operable within the refrigerating appliance 10 between various locations. In such an embodiment, the fixing bars 422 can be removed from one portion of the inner liner 18 or the door liner 64 and relocated to another portion. The fixing bars 422 and the inner liner 18 and/or door liner 64 can also define a sliding mechanism where the fixing bars 422 can be vertically operated between a plurality of vertical positions within the refrigerating appliance 10.

According to the various embodiments, when a particular modular component 34 is set in the secured position 428 between the inner liner 18 and the fixing bar 422 of the modular bin system 420, it is contemplated that the cleat member 426 being wedged between the fixing bar 422 and the inner liner 18 can serve to laterally secure the modular component 34 with respect to the fixing bar 422. It is contemplated that the cleat member 426 and/or a portion of the fixing bar 422 can include a retaining surface that extends over a portion of the fixing bar 422 or over the entire fixing bar 422, such that when the modular component 34 is in a secured position 428, the engagement between the abutment surface 36 and the cleat member 426 of the modular component 34 with the fixing bar 422 and the inner liner 18 serves to frictionally secure the modular component 34 within the cleat receptacle 424. It is contemplated that in order to remove the modular component 34 from the cleat receptacle 424 or to shift the modular component 34 laterally within the cleat receptacle 424, the user can upwardly rotate the modular component 34 to at least partially disengage the frictional engagement between the modular component 34 and cleat receptacle 424 to allow for limited movement of the modular component 34 within the cleat receptacle 424. When the modular component 34 is in the desired lateral position, the modular component 34 can be rotated downward to again define the secured position 428 of the modular component 34 within the cleat receptacle 424. According to various embodiments, movement of the modular component 34 relative to the cleat receptacle 424 can be achieved by completely removing the modular component 34 from the fixing bar 422. In such an embodiment, rotational movement of the modular component 34 relative to the fixing bar 422 is substantially limited to provide structural support for the modular component 34 in the secured position 428.

Figure 32:
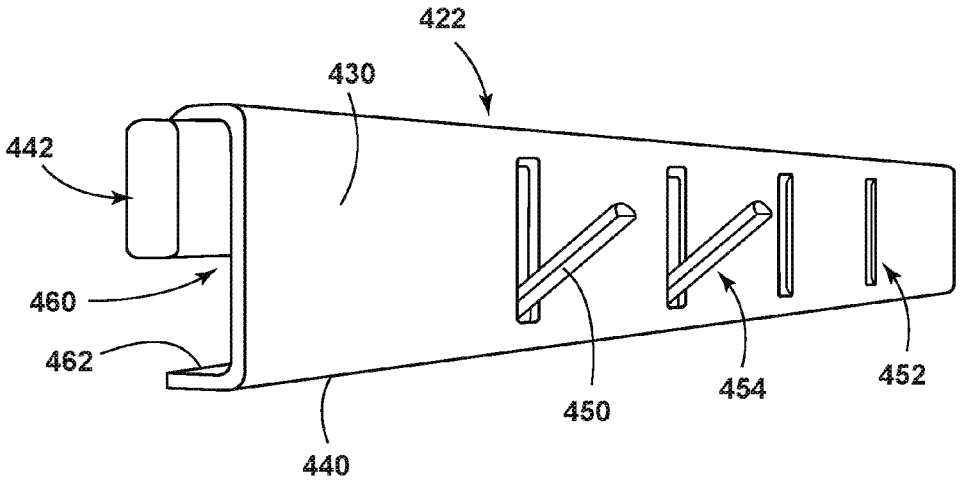
FIG. 32 is a side perspective view of a fixing bar of the modular bin system incorporated within the appliance of FIG. 30.
Figure 33:
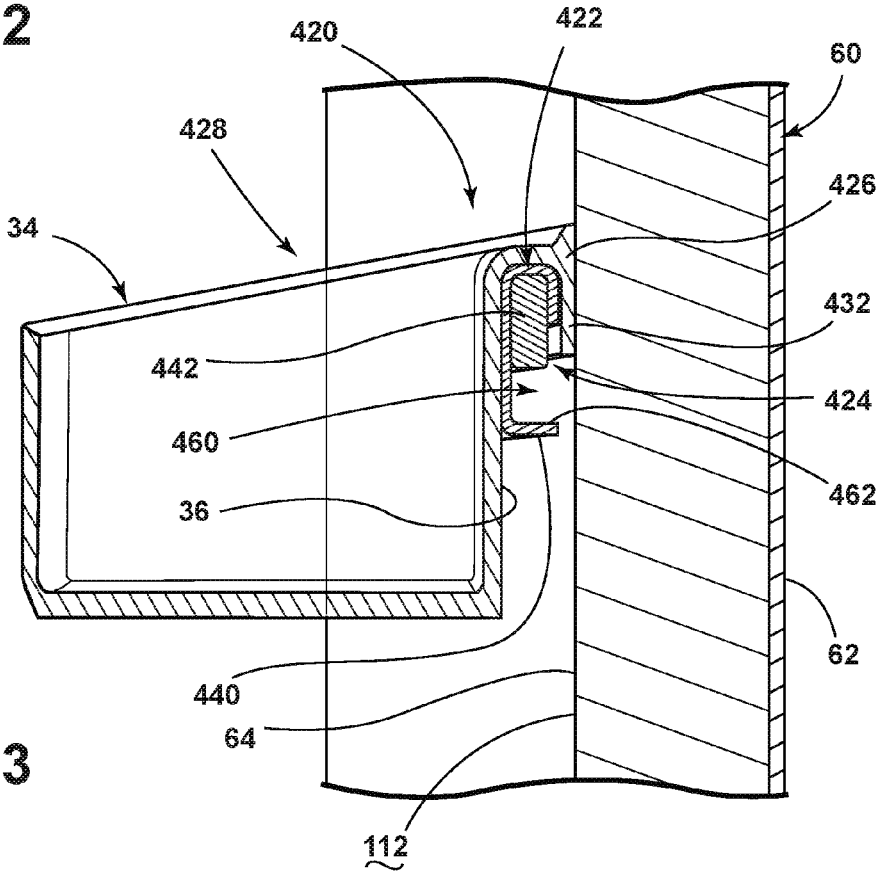
FIG. 33 is a cross-sectional view of the modular bin system of FIG. 31 taken along line XXXIII-XXXIII.
Figure 34:
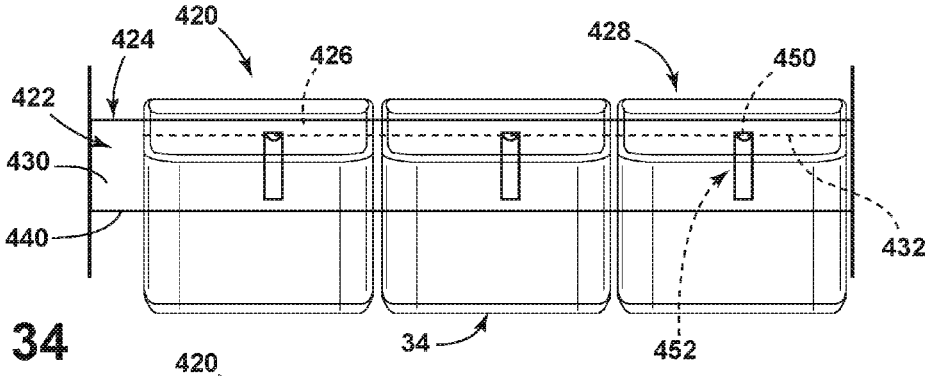
FIG. 34 is a front elevational view of an aspect of the modular bin system of FIG. 30 illustrating a potential configuration of various modular components of the universal modular component fixing system.
Figure 35:
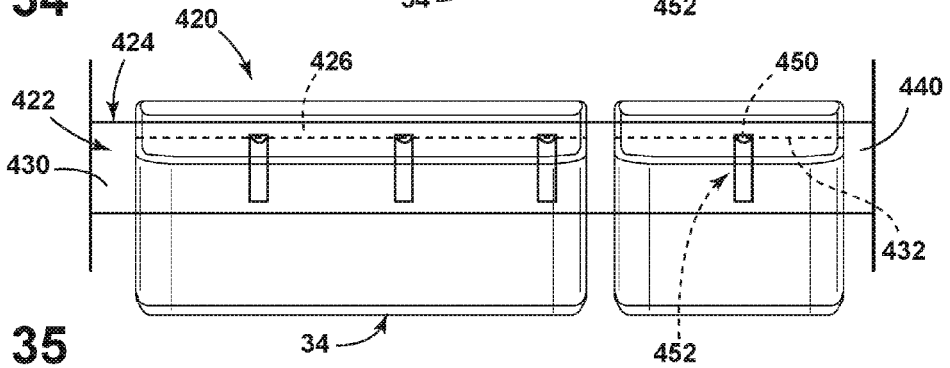
FIG. 35 is a front elevational view of an aspect of the modular bin system of FIG. 30 illustrating a potential configuration of various modular components of the universal modular component fixing system.
Figure 36:
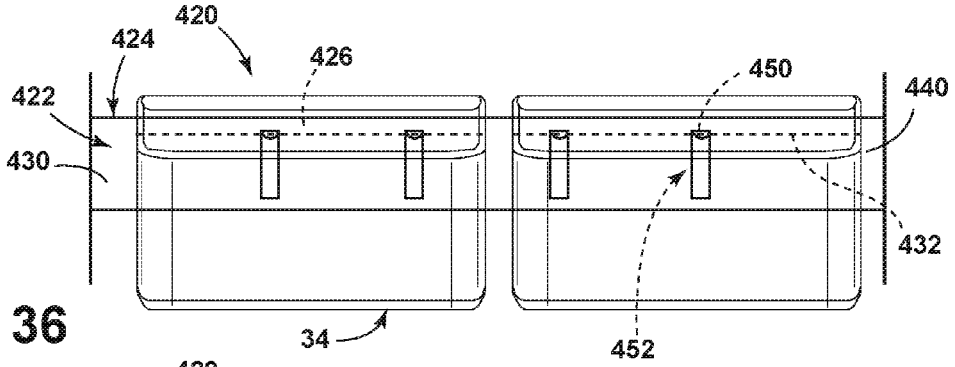
FIG. 36 is a front elevational view of an aspect of the modular bin system of FIG. 30 illustrating a potential configuration of various modular components of the universal modular component fixing system.
Figure 37:
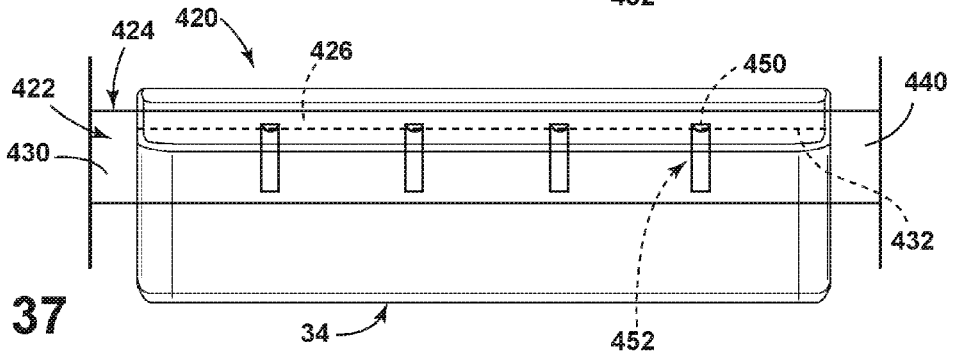
FIG. 37 is a front elevational view of an aspect of the modular bin system of FIG. 30 illustrating a potential configuration of various modular components of the universal modular component fixing system.

Referring now to the various embodiments as exemplified in FIG. 32, it is contemplated that the fixing bar 422 can include a plurality of operable hangers 450 that are operable between stowed and outward positions 452, 454. In such an embodiment, the operable hangers 450 can be set within the cover member 440 and can be rotated outward to define locations where soft containers such as bags or other similar hanging items can be disposed within the refrigerating compartment 410. It is contemplated that each of the operable hangers 450 can be moved to the outward position 454 by various operable mechanisms that can include, but are not limited to, sliding mechanisms, rotating mechanisms, bending mechanisms, combinations thereof, and other similar operable mechanisms. It is contemplated that when the operable hanger 450 is in the outward position 454, the modular component 34 is prevented from being placed in the secured position 428 over the operable hanger 450 in the outward position 454. It is also contemplated that placement of the modular component 34 into the secured position 428 can automatically serve to place the operable hanger 450 in the stowed position 452 within a portion of the fixing bar 422 and/or the cover member 440.

According to the various embodiments, the modular bin system 420 can include the modular components 34 and the operable hangers 450 to provide multiple storage options for various containers and/or food items that may be stored within the refrigerating compartment 410. Additionally, the modular components 34 and operable hangers 450 are spaced such that the modular components 34 can be moved throughout various portions of the refrigerating compartment 410 and can be placed in a myriad of vertical and lateral configurations. A basic set of modular component 34 configurations are exemplified in FIGS. 34-37 where various sizes of modular component 34 are shown. As discussed above, where a modular component 34 is not present, the operable hangers 450 can be operated to the outward position 454 to allow for a hanging function to receive various items that are not intended to be placed upon a shelf or within a drawer or other structured container within the refrigerating compartment 410.

Referring again to the various embodiments exemplified in FIGS. 30-37, the cover member 440, as discussed above, can be selectively removed from the structural bar 442 of the fixing bar 422. In this manner, the cover member 440 can be a bent elongated member that includes a hanging channel 460 that rests upon the structural bar 442 of the fixing bar 422. The hanging channel 460 can include an access aperture 462 that is sized slightly larger than the structural bar 442 to allow the cover member 440 to be placed over the structural bar 442 such that the cover member 440 can be hung from the structural bar 442 to define the fixing bar 422.

Referring again to FIGS. 30 and 31, it is contemplated that the fixing bar 422 can be placed in various locations of the refrigerated compartment 412. Such locations can include, but are not limited to, refrigerated compartment door, crisper drawers 470, refrigerated compartment drawers 472, combinations thereof, and other similar locations. It is contemplated that the fixing bar 422 can be attached at both ends to a portion of the inner liner 18, where the inner liner 18 extends through the refrigerating appliance 10, doors 60 and drawers 296 of the refrigerating compartment 410. It is also contemplated that the fixing bar 422 can extend outward from the outer surface 112 of the inner liner 18 in a generally U-shaped configuration.

Referring again to the various embodiments exemplified in FIGS. 30-37, the various modular components 34 can include any one of various sizes, shapes and configurations, where the modular components 34 can include an egg insert, various bin widths, various bin depths, crisper bins, beverage bins, and other similar bin configurations. It is also contemplated that the various modular components 34 can include or can operate in conjunction with directed lighting within the refrigerating compartment 410. As discussed above, lighting components can be incorporated within aspects of the modular component fixing system 12, such as within the fixing bar 422 to illuminate portions of the modular component 34.

Figure 38:
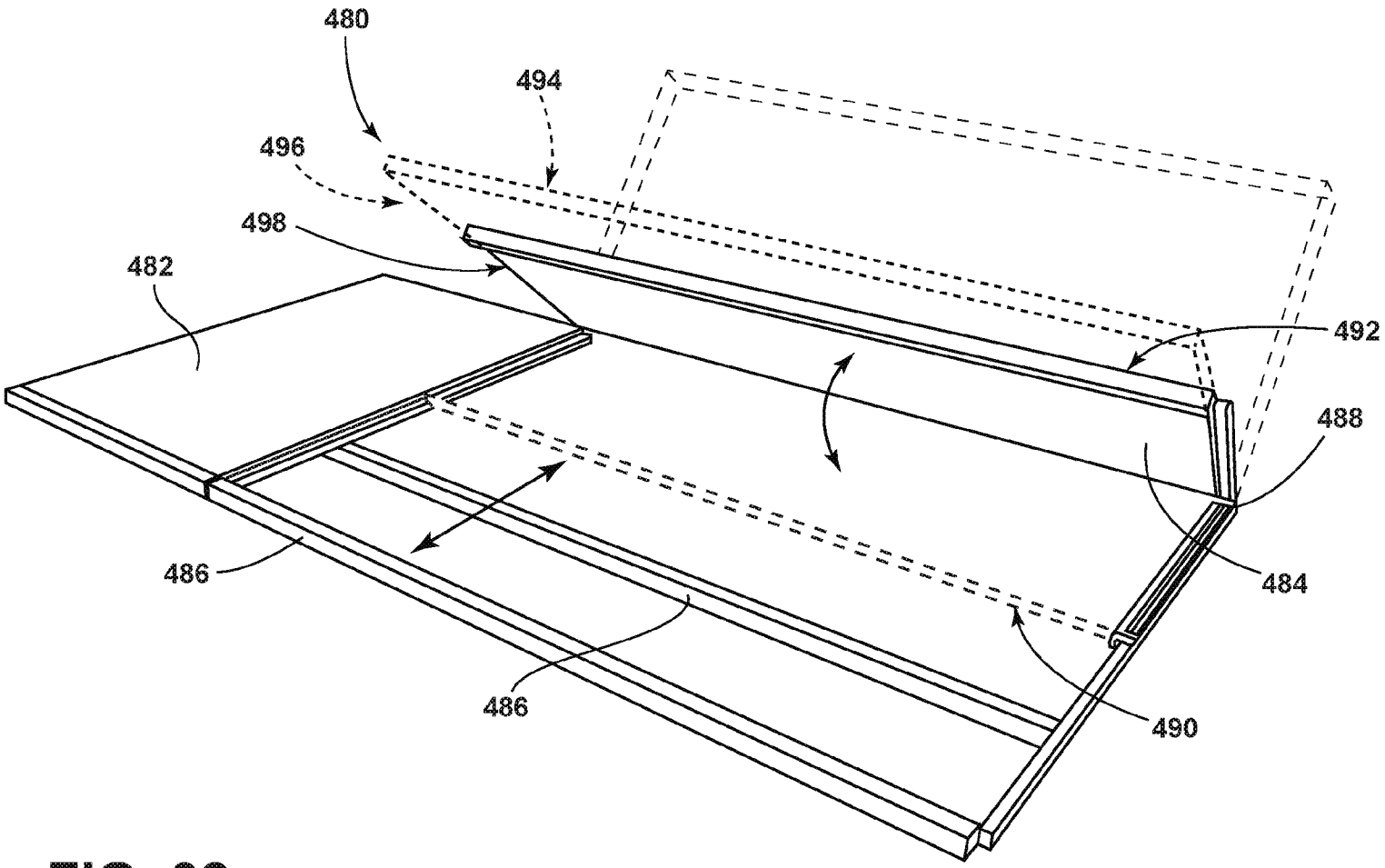
FIG. 38 is a top perspective view of an adjustable shelf incorporated within the appliance of FIG. 30 exemplifying various positions of the operable portion of the adjustable shelf.

Referring now to various aspects of the device as exemplified in FIG. 38, the modular component fixing system 12 can include an adjustable shelf 480 that includes a static portion 482 and an operable portion 484. The static portion 482 generally does not move with respect to a shelf frame 486, and provides structural support to the adjustable shelf 480. The operable portion 484 is configured to be rotationally engaged to the shelf frame 486 at a pivot 488, wherein the operable portion 484 of the adjustable shelf 480 is rotatable between a use position 490 and a non-use position 492. It is contemplated that the use position 490 of the operable portion 484 can be defined by the operable portion 484 being substantially parallel and/or within the same plane as the static portion 482 of the adjustable shelf 480. The operable portion 484 of the adjustable shelf 480 can be rotated around the pivot 488 to define the non-use position 492 such that the operable portion 484 of the adjustable shelf 480 is rotated upward such that the taller items can be placed on a lower shelf and extend through a portion of the shelf frame 486 and through the plane defined by the static portion 482 of the adjustable shelf 480. Additionally, the operable portion 484 of the adjustable shelf 480 can include an extension member 494 that can be independently and selectively operable between an extended and retracted position 496, 498. In this manner, the operable portion 484 is in the use position 490, the extension member 494 of the operable portion 484 can be slid forward and rearward to define the extended and retracted positions 496, 498. In this manner, taller items can be placed on a lower shelf and extend through a portion of the shelf frame 486. At the same time, the operable portion 484 in the use position 490 provides additional shelving space for placing smaller items upon the adjustable shelf 480. It is contemplated that the operable portion 484 and the extension member 494 of the operable portion 484 can be used in conjunction to move the operable portion 484 to a non-use position 492 when limited vertical space is available above the adjustable shelf 480. In such an embodiment, the extension member 494 can be moved to the retracted position 498 and the operable portion 484 can be rotated upward to the non-use position 492, to place the operable portion 484 against or near the outer surface 112 of the inner liner 18, such as at the rear wall or side walls of the refrigerating compartment 410, depending on the location and orientation of the adjustable shelf 480.

Referring again to FIG. 38, it is contemplated that the adjustable shelf 480 can include various accessory functions can include, but are not limited to, directed lighting, various appliance controls, drawer glides for receiving modular components 34 having sliding functionality, combinations thereof, and other similar appliance functions. It is also contemplated that the adjustable shelf 480 can include aspects of the modular component fixing system 12 including, but not limited to, aspects of the fixing bar 422, aspects of the upturned flange 28/downwardly angled channel 32, and other similar functionality for receiving and securing various modular components 34 of the modular component fixing system 12.

According to the various embodiments, the modular components 34 can also include various operable features that can include, but are not limited to, hidden lighting, soft close glides, operable hangers 450, and other similar functionalities. According to the various embodiments, the structural bar 442 of the fixing bar 422 can be made of any one of various materials that can include, but are not limited to, metal, plastic, ceramic, composite, polymer, metal alloys, combinations thereof, and other similar structural materials that are sufficiently rigid to support one or more modular components 34 thereon.

The device claimed is:

1. A modular component fixing system for an appliance, the modular component fixing system comprising:

a refrigerating appliance having an outer wrapper and an inner liner defining an insulating cavity therebetween;

a plurality of modular attachment slots defined within the inner liner, each of the plurality of modular attachment slots having an upturned flange that defines an angular recess, and wherein each of the plurality of modular attachment slots includes at least one downwardly angled channel in communication with the angular recess; and a plurality of modular components, wherein each of the plurality of modular components includes an abutment surface and a supporting flange extending from the abutment surface at a predetermined angle, the predetermined angle of the supporting flange being substantially similar to a recess angle defined by the angular recess, wherein each modular component is configured to be removably engaged with any one of the plurality of modular attachment slots by inserting the supporting flange into a corresponding angular recess of the plurality of modular attachment slots such that the abutment surface is substantially flush with an interior surface of the inner liner, wherein at least one modular component of the plurality of modular components is a drawer glide, wherein the drawer glide is adapted to receive a drawer that is operable within the drawer glide between extended and retracted positions.

2. The modular component fixing system of claim 1, further comprising:

a door of the refrigerating appliance having an outer door wrapper and an inner door liner that cooperatively define a door cavity therebetween, wherein the inner door liner includes at least a portion of the plurality of modular attachment slots that are configured to removably receive at least a portion of the plurality of modular components.

3. The modular component fixing system of claim 2, wherein each modular attachment slot includes first and second ends, wherein each of the first and second ends includes one of the at least one downwardly angled channel.

4. The modular component fixing system of claim 1, wherein the upturned flange of each corresponding modular attachment slot includes an inner surface and an outer surface, wherein the inner surface at least partially defines the angular recess of the corresponding modular attachment slot, and wherein the outer surface is substantially coplanar with adjacent portions of the inner liner surrounding the corresponding modular attachment slot.

5. An insulated wall panel system for an appliance, the insulated wall panel system comprising:

an inner liner, the inner liner having an interior surface that defines an appliance compartment, the inner liner including a plurality of convex folds that extend outward from the appliance compartment, each of the convex folds defining an angular recess that extends outward from a recess aperture defined by the interior surface of the inner liner, the angular recess in communication with the appliance compartment through the recess aperture, each of the convex folds further including a downwardly extending surface that extends downward from an outermost portion of the angular recess toward the recess aperture;

an outer wrapper disposed around the inner liner and cooperatively defining an insulating cavity with the inner liner;

an insulation layer disposed within the insulating cavity, wherein each of the plurality of convex folds extend into the insulation layer; and a plurality of modular components, wherein each of the plurality of modular components includes an abutment surface and a supporting flange extending from the abutment surface at a predetermined angle, the predetermined angle of the supporting flange being substantially similar to a recess angle define by the angular recess, wherein each modular component is configured to be removably engaged with any one of the plurality of convex folds by inserting the supporting flange into a corresponding angular recess of one of the plurality of convex folds such that the abutment surface is substantially flush with the interior surface of the inner liner, wherein at least one modular component of the plurality of modular components is a drawer glide, wherein the drawer glide is adapted to receive a drawer that is operable within the drawer glide between extended and retracted positions.

6. A modular component fixing system for an appliance, the modular component fixing system comprising:

a structural cabinet having an inner liner and a plurality of modular attachment slots defined within the inner liner, each modular attachment slot comprising:

an upturned flange that defines an angular recess; and a downwardly angled channel disposed at an edge of the upturned flange, wherein the upturned flange and the angular recess are configured to receive a supporting flange to secure a modular component of a plurality of modular components, the modular component having the supporting flange to the inner liner, wherein the modular component is a drawer glide, wherein the drawer glide is adapted to receive a drawer that is operable within the drawer glide between extended and retracted positions.

7. The modular component fixing system of claim 6, wherein each of the plurality of modular components includes an abutment surface and a corresponding supporting flange extending from the abutment surface at a predetermined angle, the predetermined angle of the corresponding supporting flange being substantially similar to a recess angle defined by the angular recess, wherein each modular component is configured to be removably engaged with any one of the plurality of modular attachment slots by inserting the corresponding supporting flange into a corresponding angular recess of the plurality of modular attachment slots such that the abutment surface is substantially flush with an interior surface of the inner liner.

8. The modular component fixing system of claim 6, wherein each modular attachment slot includes first and second ends, wherein each of the first and second ends includes the downwardly angled channel.

9. The modular component fixing system of claim 6, wherein the upturned flange of each corresponding modular attachment slot includes an inner surface and an outer surface, wherein the inner surface at least partially defines the angular recess of the corresponding modular attachment slot, and wherein the outer surface is substantially coplanar with adjacent portions of the inner liner surrounding the corresponding modular attachment slot.

* * * * *